United States Patent [19]

Misumi et al.

[11] Patent Number: 4,486,521

[45] Date of Patent: Dec. 4, 1984

[54] PHOTOCONDUCTIVE MEMBER WITH DOPED AND OXYGEN CONTAINING AMORPHOUS SILICON LAYERS

[75] Inventors: Teruo Misumi, Kawasaki; Kyosuke Ogawa, Sakurashin; Junichiro Kanbe, Yokohama; Keishi Saitoh, Tokyo; Yoichi Osato, Yokohama; Shigeru Shirai, Yamato, all of Japan

[73] Assignee: Canon Kabushiki Kaisha, Tokyo, Japan

[21] Appl. No.: 475,251

[22] Filed: Mar. 14, 1983

[30] Foreign Application Priority Data

| | | | |
|---|---|---|---|
| Mar. 16, 1982 | [JP] | Japan | 57-42222 |
| Mar. 16, 1982 | [JP] | Japan | 57-42223 |
| Mar. 16, 1982 | [JP] | Japan | 57-42224 |
| Mar. 16, 1982 | [JP] | Japan | 57-42225 |

[51] Int. Cl.[3] ..... G03G 5/14; G03G 5/04

[52] U.S. Cl. ..... 430/65; 430/66; 430/84; 430/95

[58] Field of Search ..... 430/65, 66, 88, 95

[56] References Cited

U.S. PATENT DOCUMENTS

| | | | |
|---|---|---|---|
| 4,361,638 | 11/1982 | Higashi et al. | 427/74 |
| 4,409,308 | 10/1983 | Shimizu et al. | 430/84 |

*Primary Examiner*—John E. Kittle
*Assistant Examiner*—John L. Goodrow
*Attorney, Agent, or Firm*—Fitzpatrick, Cella, Harper & Scinto

[57] ABSTRACT

A photoconductive member comprises a support for a photoconductive member and an amorphous layer containing an amorphous material comprising silicon atom as a matrix and having photoconductivity, said amorphous layer comprising a first layer region containing oxygen atom as a constituent atom, the oxygen atom being distributed continuously in the direction of the layer thickness and enriched at the support side, and a second layer region containing an atom of the group III of the periodic table as a constituent atom, said first layer region being internally present at the support side in the amorphous layer, and the layer thickness $T_B$ of said second layer region and a layer thickness T resulted from subtracting $T_B$ from the layer thickness of the amorphous layer satisfying the relation, $T_B/T \leqq 1$.

16 Claims, 16 Drawing Figures

PHOTOCONDUCTIVE MEMBER WITH DOPED AND OXYGEN CONTAINING AMORPHOUS SILICON LAYERS

BACKGOUND OF THE INVENTION

1. Field of the Invention

This invention relates to a photoconductive member having sensitivity to electromagnetic waves such as light (herein used in a broad sense, including ultraviolet rays, visible light, infrared rays, X-rays and gamma-rays and the like).

2. Description of the Prior Art

Photoconductive materials constituting photoconductive layers for solid state image pick-up devices, electrophotographic image forming members in the field of image formation, or manuscript reading devices are required to have a high sensitivity, a high SN ratio (Photocurrent (Ip)/Dark Current (Id)), absorption spectral characterstics matching to the spectral characteristics of irradiating electromagnetic waves, a good response to light, a desired dark resistance value as well as no harm to human bodies during usage. Further, in a solid state image pick-up device, it is also required that the residual image should be easily treated within a predetermined time. In particular, in case of an image forming member for electrophotography to be assembled in an electrophotographic device to be used in an office as office apparatus, the aforesaid harmless characteristic is very important.

From the standpoint as mentioned above, amorphous silicon (hereinafter referred to as "a-Si") has recently attracted attention as a photoconductive material. For example, German Laid-Open patent publication Nos. 2746967 and 2855718 disclose applications a-Si for use in image forming members for electrophotography, and German Laid-Open patent publication No. 2933411 discloses application of a-Si for use in a photoelectric converting reading device.

However, under the present situation, although the photoconductive members having photoconductive layers constituted of a-Si of the prior art have been attempted to be improved with respect to individual characteristics, including various electrical, optical and photoconductive characteristics such as dark resistance value, photosensitivity and response to light, environmental characteristics in use, and further stability with lapse of time and durability, there exists room for further improvement in overall characteristics.

For instance, when the a-Si photoconductor is applied to an image forming member for an electrophotographic device, residual potential is frequently observed to remain during use thereon if increases in both photosensitivity and dark resistance are contemplated.

When such a photoconductive member is repeatedly used for a long time, there will be caused various inconveniences such as accumulation of fatigues by repeated uses or so-called ghost phenomenon wherein residual images are formed.

Further, a-Si materials may contain as constituent atoms hydrogen atoms or halogen atoms such as fluorine atoms, chlorine atoms, etc. for improving their electrical, photoconductive characteristics, and boron atoms, phosphorus atoms, etc. for controlling the electroconductivity type, and further other atoms for improving other characteristics. Depending on the manner in which these constituent atoms are contained, there may sometimes be caused problems with respect to electrical, or photoconductive characteristics, or dielectric strength of the layer formed.

For example, sometimes there are problems as shown below. Life of photocarriers produced in the formed photoconductive layer by irradiation is not sufficiently long in said layer. At the dark portions injected of electric charge from the support side can not be sufficiently prevented.

Thus, it is required in designing a photoconductive material to make efforts to overcome all of such problems as mentioned above along with the improvement of a-Si materials per se.

In view of the above points, the present invention contemplates the achievement obtained as a result of extensive studies made comprehensively from the standpoints of applicability and utility of a-Si as a photoconductive member for image forming members for electrophotography, solid state pick-up devices and reading devices etc. It has now been found that a photoconductive member having a photoconductive layer comprising a-Si, in particular, an amorphous material constituted of at least one of hydrogen atom (H) and halogen atom (X) in a matrix of silicon (hereinafter referred to comprehensively as a-Si (H, X)), (for example, so-called hydrogenated amorphous silicon, halogenated amorphous silicon or halogen-containing hydrogenated amorphous silicon), exhibits not only practically extremely good characteristics, but also surpasses conventional photoconductive members in substantially all aspects, provided that the photoconductive member is designed and constituted to have a specific layer structure as explained in the following. The photoconductive member has markedly excellent characteristics for electrophotography.

SUMMARY OF THE INVENTION

An object of the present invention is to provide a photoconductive member having substantially constantly stable electrical, optical and photoconductive characteristics, suffering from substantially no influence from the use environment, and being markedly excellent in light fatigue resistance, excellent in durability and without causing any deterioration phenomenon after repeated uses and entirely or substantially free from residual potentials.

Another object of the present invention is to provide a photoconductive member, which is sufficiently capable of bearing charges at the time of charging treatment for formation of electrostatic charges to an extent that a conventional electrophotographic method can be very effectively applied when it is provided for use as an image forming member for electrophotography.

Still another object of the present invention is to provide a photoconductive member for electrophotography capable of providing easily a high quality image which is high in density, clear in half-tone and high in resolution.

A further object of the present invention is to provide a photoconductive member having high photosensitivity, high SN ratio characteristic and high dielectric strength.

According to the present invention, there is provided a photoconductive member which comprises a support for a photoconductive member and an amorphous layer containing an amorphous material comprising silicon atom as a matrix and having photoconductivity, said amorphous layer comprising a first layer region containing oxygen atom as a constituent atom, the oxygen atom being distributed continuously in the direction of the layer thickness and enriched at the support side, and a second layer region containing an atom of the group III of the periodic table as a constituent atom, said first layer region being internally present at the support side in the amorphous layer, and the layer thickness $T_B$ of said second layer region and a layer thickness T resulted from subtracting $T_B$ from the layer thickness of the amorphous layer satisfying the relation, $T_B/T \leqq 1$.

DETAILED DESCRIPTION OF THE PREFERRED EMBODIMENT

The photoconductive members of the present invention will be explained with reference to the drawings in the following.

Figure 1:
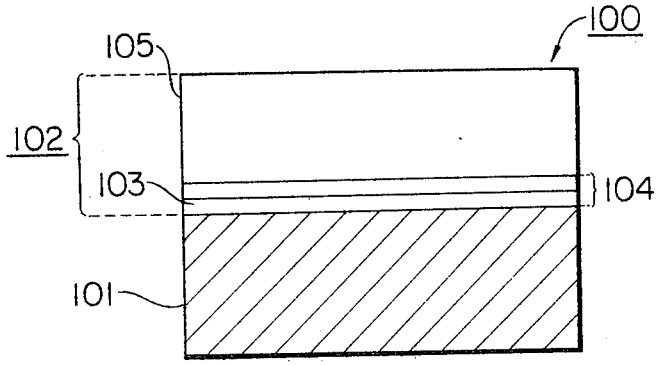
FIGS. 1 and 11 are schematic layer constitutions for illustrating a layer constitution of a photoconductive member according to this invention.

FIG. 1 shows a schematic layer constitution to be used for illustrating a layer constitution of a photoconductive member according to this invention.

In FIG. 1, a photoconductive member 100 has a support 101 for a photoconductive member and an amorphous layer 102 comprising a-Si, preferably a-Si(H,X) and exhibiting photoconductivity overlying support 101. Amorphous layer 102 has a layer structure which is constituted of a first layer region (O) 103 and a second layer region (III) 104, said first layer region (O) 103 contains oxygen atom as a constituent atom which is distributed continuously in the direction of the layer thickness and enriched at the side of support 101, and said second layer region (III) 104 contains the group III atom as constituent atoms.

In an example as shown in FIG. 1, the first layer region (O) 103 has such a layer structure as the first layer region (O) 103 per se constitutes a part of the second layer region (III) 104, and the first layer region (O) 103 and the second layer region (III) 104 are present internally under the surface of amorphous layer 102.

Oxygen atom which is presumably a factor to affect humidity resistance and corona ion resistance is not contained in the upper layer region 105 of an amorphous layer 102, but only in the first layer region (O) 103. Enhancing the dark resistance and enhancing the adhesion between a support 101 and an amorphous layer 102 are mainly contemplated by incorporating oxygen atoms in the first layer region (O) 103 while enhancing photosensitivity is mainly contemplated by incorporating no oxygen atom in the upper layer region 105. Oxygen atom contained in the first layer region (O) 103 is distributed continuously and nonuniformly in the direction of the layer thickness while oxygen atom is contained in the first layer region (O) 103 and is substantially uniformly distributed in a plane parallel to the interface between support 101 and amorphous layer 102.

As a group III atom contained in the second layer region (III) 104 of amorphous layer 102, there may be mentioned B (boron), Al (aluminium), Ga (gallium), In (indium), Tl (thallium) and the like, particularly preferably B and Ga.

The distribution state of the group III atom contained in the second layer region (III) 104 is made substantially uniform both in the direction of the layer thickness and in a plane parallel to the surface of support 101.

Since the layer thickness of the first layer region (O) 103 and that of the upper layer region 105 are one of the important factor to achieve the object of this invention, it is desirable to take a sufficient care for the design of a photoconductive member so that the intended characteristics may be sufficiently imparted to a photoconductive member to be formed.

In the present invention, the upper limit of the layer thickness $T_B$ of the second layer region (III) 104 is preferably 50μ, more preferably 30μ, and most preferably 10μ.

Besides, the lower limit of the layer thickness T of the upper layer region 105 is preferably 0.5μ, more preferably 1μ, and most preferably 3μ.

The lower limit of the layer thickness $T_B$ of the second layer region (III) 104 and the upper limit of the layer thickness T of the upper layer region 105 are preferably determined depending upon the organic relation between the characteristics required for the both layer regions and the characteristics required for the whole amorphous layer 102.

In the present invention, the lower limit of the layer thickness $T_B$ and the upper limit of the layer thickness T are usually selected such that the relation $T_B/T \leqq 1$ is satisfied.

Moreover, in above selection of the values of the layer thicknesses $T_B$ and T, it is desirable that they preferably satisfies the relation $T_B/T \leqq 0.9$; more preferably $T_B/T \leqq 0.8$.

In FIG. 1, the first layer region 103 is formed in the second layer region 104 containing the group III atom, but the first layer region (O) and second layer region (III) may be in the same single region.

Further, it can be also one of the preferable embodiments that the second layer region (III) is formed in the first layer region (O).

The content of oxygen atom in the first layer region (O) may be properly selected depending on the characteristics required for the photoconductive member to be formed. It may be preferably 0.001–50 atomic %, more preferably 0.002–40 atomic % and most preferably 0.003–30 atomic %.

When the layer thickness To of the first layer region (O) is sufficiently high or the ratio of To to the whole thickness of the amorphous layer is more than 2/5, the upper limit of oxygen atom in the first layer region (O) is preferably 30 atomic %, more preferably 20 atomic %, and most preferably 10 atomic %.

In the present invention, the layer thickness of the amorphous layer is preferably 1–100μ, more preferably 1–80μ, and most preferably 2–50μ from the standpoint of the characteristics required for the electrophotography as well as from the economical point of view.

FIG. 2 through FIG. 10 show typical examples of the distribution state of oxygen atom in the direction of the layer thickness in the first layer region (O) containing oxygen atom of the amorphous layer in a photoconductive member according to the present invention.

In the examples in FIG. 2 through FIG. 10, the layer region (III) containing the group III atom may be the same layer region as the layer region (O), may include the layer region (O), or may share a part with the layer region (O). Therefore, in the following description the layer region (III) containing thegroup III atom will not be referred to unless any particular explanation is necessary.

In FIGS. 2 through 10, the abscissa indicates the content C of the oxygen atoms and the ordinate the layer thickness To of the layer region (O) containing the oxygen atoms constituting the amorphous layer exhibiting photoconductivity, $t_B$ showing the position of the interface on the support side and $t_T$ the position of the interface on the side opposite to the support side. That is, the layer region (O) containing the oxygen atoms is formed from the $t_B$ side toward the $t_T$ side.

In the present invention, the first layer region (O) containing the oxygen atoms consists of a-Si, preferably a-Si(H,X) constituting the photoconductive member, and it may occupy a part of the region of the amorphous layer exhibiting photoconductivity.

In the first layer region (O), it is preferred in an example shown in FIG. 1 that said layer should be provided as the lower layer region of the amorphous layer 102 containing the interface on the side of the support 101 in the amorphous layer 100.

Figure 2:
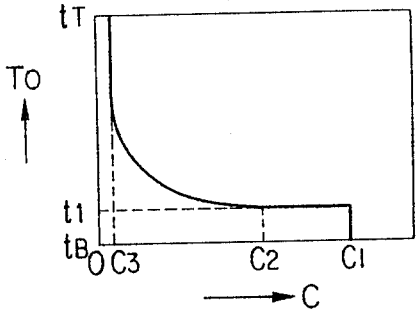
FIGS. 2 through 10 show the respective examples to be used for illustrating the distribution of oxygen atoms contained in a layer region (O) of an amorphous layer.

In FIG. 2, there is shown a first typical example of the distribution of the oxygen atoms in the layer thickness direction contained in the first layer region (O).

According to the example as shown in FIG. 2, from the interface position $t_B$ between the first layer region (O) and a surface on which the first layer region (O) is formed to the other interface position $t_1$, the oxygen atoms are contained in the layer region (O) formed with the concentration of the oxygen atoms taking a constant value of $C_1$, and from the position $t_1$ to the interface position $t_T$, the concentration being gradually decreased from the concentration $C_2$. At the interface position $t_T$, the concentration C of the group III atoms is made $C_3$.

Figure 3:
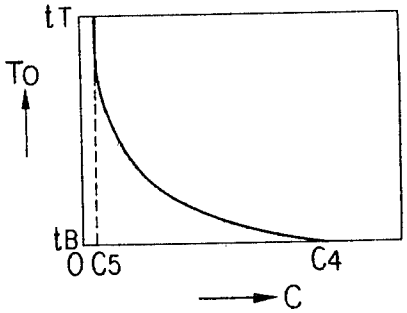

In the example as shown in FIG. 3, there is created a distribution such that the concentration C of the oxygen atoms is continuously gradually decreased from the position $t_B$ to the position $t_T$ from the concentration $C_4$, until it becomes the concentration $C_5$ at the position $t_T$.

Figure 4:
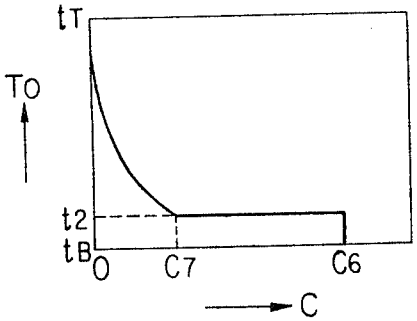

In case of FIG. 4, the concentration C of the oxygen atoms is maintained at a constant value of $C_6$ from the position $t_B$ to the position $t_2$, gradually continuously decreased between the position $t_2$ and the position $t_T$, and at the position $t_T$ the concentration C is made substantially zero.

Figure 5:
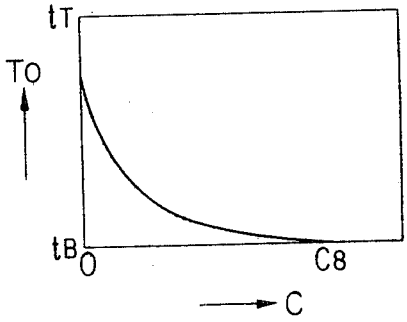

In case of FIG. 5, the oxygen atoms are continuously gradually decreased in concentration from the concentration $C_8$ from the position $t_B$ to the position $t_T$ at which the concentration is made substantially zero.

Figure 6:
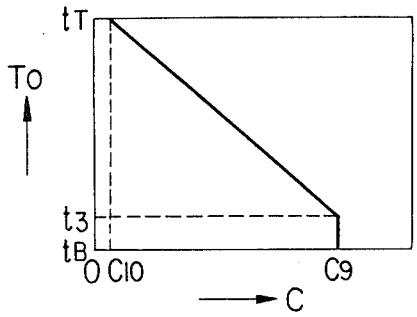

In the example shown in FIG. 6, the concentration C of the oxygen atoms is maintained at a constant value of $C_9$ from the position $t_B$ to $t_3$ and is made $C_{10}$ at the position $t_T$. Between the position $t_3$ and the position $t_T$, the concentration C is decreased in a linear function from the position $t_3$ to the position $t_T$.

Figure 7:
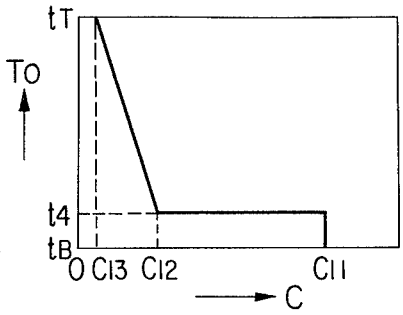

In the example as shown in FIG. 7, the distribution is made such that a constant value of $C_{11}$ is taken from the position $t_B$ to the position $t_4$, and the concentration C is decreased in a linear function from the concentration $C_{12}$ to the concentration $C_{13}$ from the position $t_4$ to the position $t_T$.

Figure 8:
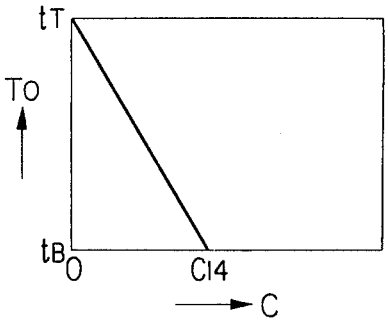

In the example as shown in FIG. 8, the concentration C of the oxygen atoms is decreased from the position $t_B$ to the position $t_T$ in a linear function from the concentration $C_{14}$ to zero.

Figure 9:
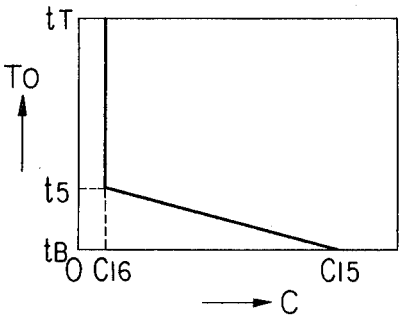

In FIG. 9, there is shown an example in which the concentration C of the oxygen atoms is decreased from the position $t_B$ to the position $t_5$ in a linear function from the concentration $C_{15}$ to the concentration $C_{16}$, and maintained at a constant value of $C_{16}$ between the position $t_5$ and the position $t_T$.

Figure 10:
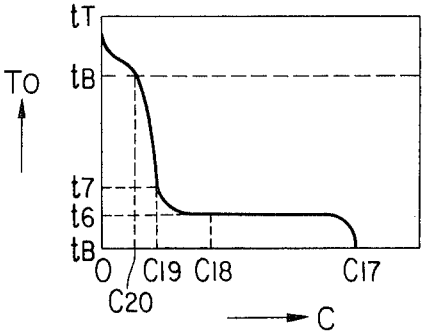

In the example as shown in FIG. 10, the concentration C of the oxygen atoms is the concentration $C_{17}$ at the position $t_B$, which is then initially gradually decreased to the position $t_6$ and abruptly decreased near the position $t_6$ to the concentration $C_{18}$ at position $t_6$. Between the position $t_6$ and the position $t_7$, the concentration is abruptly decreased at the beginning and then gradually decreased and becomes the concentration $C_{19}$ at the position $t_7$, and between the position $t_7$ and the position $t_8$, with a very gradual decrease, reaches the concentration $C_{20}$ at $t_8$. Between the position $t_8$ and the position $t_T$, the concentration is decreased from $C_{20}$ along the curve as shown in the drawing to substantially zero.

In the above, there are shown some typical examples of the distributions in the layer thickness direction of the oxygen atoms contained in the layer region (O) by referring to the FIG. 2 to FIG. 10. In the present invention, there is provided in the amorphous layer a first layer region (O), having a portion with higher value of the concentration C of the oxygen atoms on the support side, and having a portion with said concentration C which has been made relatively lower on the interface $t_T$ side, as compared with that on the suport side.

In the present invention, it is desirable that the first layer region (O) constituting the amorphous layer has a localized region (A) containing the oxygen atoms at higher concentration on the support side as described above. Thus the adhesion between the support and the amorphous layer can be improved.

The localized region (A) may preferably be provided at a position, in terms of the symbols shown in FIGS. 2 to 10, within 5μ from the interface position $t_B$.

In such a case as described above, the above localized region (A) may be made the whole layer region ($L_T$) ranging from the interface position $t_B$ to the 5-micron thickness in some cases, or a part thereof in other cases.

It may be suitably determined depending on the characteristics required for the amorphous layer formed, whether the localized region (A) should be made a part or whole of the layer region ($L_T$).

The localized region (A) may be desirably formed so that the oxygen atoms may be distributed in the layer thickness direction with the maximum distribution value of the oxygen atoms (concentration distribution value) $C_{max}$ being preferably 500 atomic ppm or more, more preferably 800 atomic ppm or more, most preferably 1000 atomic ppm or more.

That is, in the present invention, the first layer region (O) containing the oxygen atoms may be preferably formed so that the maximum value $C_{max}$ of the content distribution may exist at a depth within 5μ of layer thickness from the support side (layer region of 5 μ thickness from $t_B$).

In the present invention, the content of the group III atoms to be contained in the second layer region (III) may be suitably determined as desired to achieve the object of the present invention, but it is preferably in the range from 0.01 to $5\times10^4$ atomic ppm, more preferably from 0.5 to $1\times10^4$ atomic ppm, most preferably from 1 to $5\times10^3$ atomic ppm.

The support to be used in the present invention may be either electroconductive or insulating. As the electroconductive support, there may be mentioned metals such as NiCr, stainless steel, Al, Cr, Mo, Au, Nb, Ta, V, Ti, Pt, Pd etc. or alloys thereof.

As insulating supports, there may conventionally be used films or sheets of synchetic resins, including polyesters, polyethylene, polycarbonates, cellulose acetate, polypropylene, polyvinyl chloride, polyvinylidene chloride, polystyrene, polyamides, etc., glasses, ceramics, papers and so on. These insulating supports may preferably have at least one surface subjected to electroconductive treatment, and it is desirable to provide other layers on the side to which said electroconductive treatment has been applied.

For example, electroconductive treatment of a glass can be effected by providing a thin film of NiCr, Al, Cr, Mo, Au, Ir, Nb, Ta, V, Ti, Pt, Pd, $In_2O_3$, $SnO_2$, ITO ($In_2O_3+SnO_2$) thereon. Alternatively, a synthetic resin film such as polyester film can be subjected to the electroconductive treatment on its surface by vacuum vapor deposition, electron-beam deposition or sputtering of a metal such as NiCr, Al, Ag, Pb, Zn, Ni, Au, Cr, Mo, Ir, Nb, Ta, V, Ti, Pt, etc. or by laminating treatment with said metal, thereby imparting electroconductivity to the surface. The support may be shaped in any form such as cylinders, belts, plates or others, and its form may be determined as desired. For example, when the photoconductive member 100 in FIG. 1 is to be used as an image forming member for electrophotography, it may desirably be formed into an endless belt or a cylinder for use in continuous high speed copying. The support may have a thickness, which is conveniently determined so that a photoconductive member as desired may be formed. When the photoconductive member is required to have a flexibility, the support is made as thin as possible, so far as the function of a support can be exhibited. However, in such a case, the thickness is generally 10μ or more from the points of fabrication and handling of the support as well as its mechanical strength.

In the present invention, formation of an amorphous layer comprising a-Si(H,X) may be conducted by the vacuum deposition method utilizing discharging phenomenon such as the glow discharge method, the sputtering method or the ion-plating method. For example, for the formation of an amorphous layer comprising a-Si(H,X) according to the glow discharge method, the basic procedure comprises introducing the starting gases for supplying hydrogen atoms (H) and/or halogen atoms (X) together with a starting gas capable of supplying silicon atoms (Si), into a deposition chamber which can be internally brought to a reduced pressure, wherein glow discharge is excited thereby to form a layer comprising a-Si(H,X) on the surface of a support placed at a predetermined position in said chamber.

When it is formed according to the sputtering method, the starting gas for supplying hydrogen atoms (H) and/or halogen atoms (X) may be introduced into a deposition chamber for sputtering upon effecting sputtering with a target constituted of Si in an atmosphere of an inert gas such as Ar, He and the like or the gas mixture based on these gases.

In the present invention, as the halogen atoms (X), which may be introduced into the amorphous layer if necessary, there may be mentioned fluorine, chlorine, bromine and iodine, particularly, fluorine and chlorine are preferred.

The starting gas for supplying Si to be used in the present invention may include gaseous or gasifiable silicon hydrides (silanes) such as $SiH_4$, $Si_2H_6$, $Si_3H_8$, $Si_4H_{10}$ and the like. In particular, $SiH_4$ and $Si_2H_6$ are preferred with respect to easy handling during formation and efficiency for supplying Si.

As the effective starting gas for incorporation of halogen atoms to be used in the present invention, there may be employed a number of halogen compounds including gaseous or gasifiable halogen compounds such as halogen gases, halides, interhalogen compounds, silane derivatives substituted by halogens and the like.

Further, there may be also included gaseous or gasifiable silicon compounds containing halogen atoms, which comprises silicon atoms (Si) and halogen atoms (X) as constituents, as effective materials to be used in the present inventions.

As the halogen compounds preferably used in the present invention, there may be included halogen gases such as fluorine, chlorine, bromine and iodine, and interhalogen compounds such as BrF, ClF, $ClF_3$, $BrF_5$, $BrF_3$, $IF_2$, $IF_7$, ICl, IBr and the like.

As silicon compounds containing halogen atoms, so called as silane derivatives substituted by halogen atoms, there may be included preferably silicon halides, e.g. specifically $SiF_4$, $Si_2F_6$, $SiCl_4$, $SiBr_4$ and the like.

When the formation of a particular photoconductive member according to the present invention is carried out by the glow discharging method employing the above mentioned silicon compounds containing halogen atoms, it is possible to form an amorhpus layer constituted of a-Si containing halogen atoms on a support placed at a predetermined position without employing a silicon hydride gas as the starting gas capable of supplying Si.

When an amorphous layer containing halogen atoms is formed on a predetermined support according to the glow discharging method, the basic procedure comprises introducing the silicon halides gases as starting gases capable of supplying Si together with a gas such as Ar, $H_2$, He gases and the like at a predetermined mixing ratio and gas flow rate into a deposition chamber where an amorphous layer can be formed, and forming a plasma atmosphere of these gases by exciting a glow discharging, but it is also permitted to mix a predetermined amount of a gas of a silicon compound containing hydrogen atom with the abovementioned gases in order to supply hydrogen atoms for the formation of said layer.

These gases may be used alone or in combination at a predetermined mixing ratio.

The formation of an amorphous layer constituted of a-Si(H,X) according to the reactive sputtering method or ion plating method may be carried out as shown below. For example, when the sputtering method is employed, sputtering is effected with a target constituted of Si in an atmosphere of a predetermined gas plasma, and when the ion plating method is employed, the polycrystalline silicon or single crystalline silicon as the source for evaporation is placed in a vacuum evaporation boat, followed by causing the evaporation of said silicon source by means of a resistant heating method or electron beam method (EB method) and passing the flying evaporates through the atmosphere of the predetermined gas plasma.

In the sputtering method or the ion plating method, introducing halogen atoms into the layer to be formed may be accomplished by introducing the halogen compound gas or a gas of the silicon compound containing a halogen atom into the depositing chamber followed by the formation of an atmosphere of plasma of said gas.

Likewise, introducing hydrogen atoms may be accomplished by introducing, for example, $H_2$ or the abovementioned silane gas and the like into the depositing chamber for sputtering followed by the formation of atmosphere of plasma of said gas.

In the present invention, while the aforementioned halogen compounds or halogen containing silicon compounds may be employed as an effective starting gas for introducing halogen atoms, there may be also employed gasous or gasifiable halogen compounds having hydrogen atoms as one of the constituent elements for example, hydrogen halides such as HF, HCl, HBr, and HI, halo-substituted silicon hydrides such as $SiH_2F_2$, $SiH_2I_2$, $SiH_2Cl_2$, $SiHCl_3$, $SiH_2Br_2$, $SiHBr_3$ and the like as effective starting materials for forming the amorphous layer.

These hydrogen-containing halogen compounds can introduce hydrogen atom as well as halogen atom into the amorphous layer upon forming said layer, and hydrogen atom is very effective for controlling the electrical or photoelectrical characteristics. Therefore, the hydrogen-containing halogen compounds are preferable starting materials for introducing halogen atom.

Introducing the hydrogen atoms as constituent into an amorphous layer may be also achieved by coexisting $H_2$ or a silicon halide gas such as $SiH_4$, $Si_2H_6$, $Si_3H_8$, $Si_4H_{10}$ and the like with a silicon compound for introducing Si into the depositing chamber and exciting discharging therein.

For example, when the reactive sputtering method is employed, an amorphous layer comprising a-Si(H,X) may be formed on a support by introducing the gas for supplying halogen atoms and $H_2$ gas and optionally inert gas such as He, Ar and the like into the depositing chamber, followed by forming the plasma atmosphere and by sputtering with the Si target.

There may be permitted to introduce a gas such as $B_2H_6$ and the like which can also serve for doping with impurity.

In the present invention, the amount of hydrogen atom (H) or halogen atom (X) or the sum amount (H+X) of hydrogen atom and halogen atom to be contained in an amorphous layer of the photoconductive member to be formed may be preferably 1–40 atomic %, more preferably 5–30 atomic %.

Controlling the amount of hydrogen atom (H) and/or halogen atom (X) to be contained in an amorphous layer may be effected by controlling e.g. the support temperature and/or the amount of the starting materials for supplying hydrogen atoms (H) or halogen atoms (X) to be introduced into the depositing device system, the discharging power, and the like.

Forming the seocnd layer region (III) containing the group III atoms and the first layer region (O) containing oxygen atoms in an amorphous layer may be accomplished by employing the starting materials for supplying the group III atoms and oxygen atoms, respectively, together with the aforementioned starting materials for forming an amorphous layer while controlling the amount of said materials to be introduced into the layer to be formed when said amorphous layer is formed by glow discharging method or reactive sputtering method.

When the glow discharging method is employed for the formation of the first layer region (O) containing oxygen atoms and the second layer region (III) containing the group III atoms in the amorphous layer, as the starting material used for the starting gas for forming each layer region, there may be used a starting material desirably selected from the above mentioned materials for forming the amorphous layer and a starting material for introducing oxygen atom and/or that for introducing the group III atom.

As those starting materials for supplying oxygen atoms or the group III atoms, it is possible to use most of the gases which are selected from the gaseous substances or gasified gasifiable substances containing at least oxygen atom or group III atom.

For example, for producing a layer region (O), there may be used a mixture of a starting gas containing silicon atom (Si) as a constituent atom, a starting gas containing oxygen atom (O) as a constituent atom and, if desired, a starting gas containing hydrogen atom (H) and/or halogen atom (X) as constituent atoms at a desired mixing ratio; there may be used a mixture of a starting gas containing silicon atom (Si) as a constituent atom and a starting gas containing oxygen atom (O) and hydrogen atom (H) as constituent atom at a desired mixing ratio; or there may be used a mixture of a starting gas containing silicon atom (Si) as a constituent atom and a starting gas containing silicon atom (Si), oxygen atom (O) and hydrogen atom (H) as constituent atoms.

In addition, a mixture of a starting gas having silicon atom (Si) and hydrogen atom (H) as constituents atoms and a starting gas having oxygen atom (O) as a constituent atom may be also acceptable.

As the starting materials for introducing oxygen atoms, there may be mentioned specifically, for example, oxygen ($O_2$), ozone ($O_3$), nitrogen monooxide (NO), nitrogen dioxide ($NO_2$), dinitrogen monooxide ($N_2O$), dinitrogen trioxide ($N_2O_3$), dinitrogen tetraoxide ($N_2O_4$), dinitrogen pentoxide ($N_2O_5$) and nitrogen trioxide ($NO_3$) as well as lower siloxanes comprising silicon atom (Si), oxygen atom (O) and hydrogen atom (H) as constituent atoms such as disiloxane ($H_3SiOSiH_3$) and trisiloxane ($H_3SiOSiH_2OSiH_3$) and the like.

When the layer region (III) is formed by a glow discharging method, as effective starting materials for the introduction of the group III atoms, there may be mentioned boron hydrides such as $B_2H_6$, $B_4H_{10}$, $B_5H_9$, $B_5H_{11}$, $B_6H_{10}$, $B_6H_{12}$, $B_6H_{14}$and the like, boron halides such as $BF_3$, $BCl_3$, $BBr_3$and the like for the introduction of boron atoms. In addition, there may also be included $AlCl_3$, $GaCl_3$, $Ga(CH_3)_3$, $InCl_3$and the $TlCl_3$and the like.

The contents of the group III atoms to be introduced into the layer region (III) may be controlled freely by controlling the gas flow rate, the gas flow rate ratio of the starting materials for introducing the group (III) atoms, the discharging power, the support temperature and the pressure in the depositing chamber and others.

For the formation of the layer region (O) containing oxygen atoms by sputtering method, single crystalline or polycristalline Si wafer, or $SiO_2$ wafer, or a wafer containing both Si and $SiO_2$ may be used as a target in an atmosphere of various gases to effect sputtering.

For example, when a Si wafer is employed as a target, a starting gas for the introduction of oxygen atoms and optionally hydrogen atoms and/or halogen atoms which may be, if desired, diluted with a dilution gas are introduced into the depositing chamber for sputtering and the gas plasma of the gases is produced to effect sputtering with the Si wafer target.

Alternatively, Si and $SiO_2$ are used as separate targets, or a sheet of target composed of Si and $SiO_2$ is used, and the sputtering may be effected in an atmosphere of a diluting gas or a gas atmosphere where the gas contains at least hydrogen atom (H) and/or halogen atom (X) as constituent atoms.

As a starting gas for introducing oxygen atom, the starting gas for introducing oxygen atom as mentioned in the glow discharging method above may be also used for sputtering as an effective gas.

In the present invention, as diluting gases for the formation of an amorphous layer according to the glow discharging method, or gases for the formation of an amorphous layer according to the sputtering method, there may be employed so-called rare gases such as He, Ne, Ar, and the like.

Figure 11:
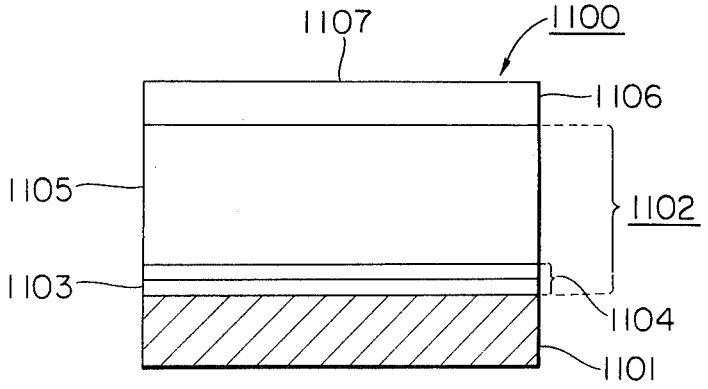

FIG. 11 shows a schematical diagram to be used for illustrating another preferable embodiment of the layer constitution according to the present invention.

In FIG. 11, a photoconductive member 1100 has a support 1101 for a photoconductive member and a first amorphous layer (I) 1102 overlying support 1101, comprising a-Si(H,X) and exhibting photoconductivity, and a second amorphous layer (II) 1106 comprising an amorphous material (hereinafter referred to as "a-SiC(H,X)") which contains silicon atom, carbon atom and optionally at least any one of hydrogen atom (H) and halogen atom (X).

Photoconductive member 1100 as shown in FIG. 11 has a similar layer constitution to the photoconductive member as shown already in FIG. 1 except that the second amorphous layer (II) 1106 is mounted on the first amorphous layer (I) 1102.

That is, the first amorphous layer (I) 1102 has a layer constitution that the first layer region (O) 1103 contains oxygen atom as a constituent atom continuously distributed in the direction of the layer thickness and higher concentrated toward the side of said support 1101 and the second layer region (III) 1104 contains the group III atom as a constituent atom.

The second amorphous layer (II) 1106 is provided primarily for the purpose of accomplishing the objects of the present invention with respect to humidity resistance, continuous repeated use characteristics, dielectric strength, enrivonmental characteristics in use and durability.

In the photoconductive member 1100 as shown in FIG. 11, since each of the amorphous materials forming the first amorphous layer (I) 1102 and the second amorphous layer (II) 1106 have the common constitutent of silicon atom, chemical and electric stabilities are sufficiently ensured at the laminated interface.

As a-SiC(H,X) constituting the second amorphous layer (II), there may be mentioned an amorphous material constituted of silicon atoms and carbon atoms (a-$Si_aC_{1-a}$, where $0<a<1$), an amorphous material constituted of silicon atoms, carbon atoms and hydrogen atoms [a-$(Si_bC_{1-b})_cH_{1-c}$, where $O<a$, $b<1$] and an amorphous material constituted of silicon atoms, carbon atoms, halogen atoms (X) and, if desired, hydrogen atoms [a-$(Si_dC_{1-d})_e(X,H)_{1-e}$, where $O<d$, $e<1$] as effective materials.

Formation of the second amorphous layer (II) constituted of a-SiC(H,X) may be performed according to the glow discharge method, the sputtering method, the ion implantation method, the ion plating method, the electron beam method, etc. These preparation methods may be suitably selected depending on various factors such as the preparation conditions, the degree of the load for capital investment for installations, the production scale, the desirable characteristics required for the photoconductive member to be prepared, etc. For the advantages of relatively easy control of the preparation conditions for preparing photoconductive members having desired characteristics and easy introduction of silicon atoms and carbon atoms, optionally together with hydrogen atoms or halogen atoms, into the second amorphous layer (II) to be prepared, there may preferably be employed the glow discharge method or the sputtering method.

Further, in the present invention, the second amorphous layer (II) may be formed by the glow discharge method and the sputtering method in combination in the same device system.

For formation of the second amorphous layer (II) according to the glow discharge method, starting gases for formation of a-SiC(H,X), optionally mixed at a predetermined mixing ratio with diluting gas, may be introduced into a deposition chamber for vacuum deposition in which a support is placed, and the gas introduced is made into a gas plasma by excitation of glow discharging, thereby depositing a-SiC(H,X) on the first amorphous layer (I) which has already been formed on the aforesaid support.

As the starting gases for formation of a-SiC(H,X) to be used in the present invention, it is possible to use most of gaseous substances or gasified gasifiable substances containing at least one of Si, C, H and X as constituent atoms.

In case when a starting gas having Si as constitutent atoms as one of Si, C, H and X is employed, there may be employed, for example, a mixture of a starting gas containing Si as constituent atom, a starting gas containing C as constituent atom and a starting gas containing H or X as constituent atom at a desired mixing ratio, or alternatively a mixture of a starting gas containing Si as constituent atoms with a starting gas containing C and H or X also at a desired mixing ratio, or u a mixture of a starting gas containing Si as constituent atoms with a gas containing three atoms of Si, C and H or of Si, C and X as constituent atoms.

Alternatively, it is also possible to use a mixture of a starting gas containing Si and H or X as constituent atoms with a starting gas containing C as constituent atom.

In the present invention, the starting gases effectively used for formation of the second amorphous layer (II) may include silicon hydride gases containing Si and H as constituent atoms such as silanes (e.g. $SiH_4$, $Si_2H_6$, $Si_3H_8$, $Si_4H_{10}$, etc.), compounds containing C and H as constituent atoms such as saturated hydrocarbons having 1 to 5 carbon atoms, ethylenic hydrocarbons having 2 to 5 carbon atoms and acetylenic hydrocarbons haivng 2 to 4 carbon atoms.

More specifically, there may be included, as saturated hydrocarbons, methane ($CH_4$), ethane ($C_2H_6$), propane ($C_3H_8$), n-butane (n-$C_4H_{10}$), pentane ($C_5H_{12}$); as ethylenic hydrocarbons, ethylene ($C_2H_4$), propylene ($C_3H_6$), butene-1 ($C_4H_8$), butene-2 ($C_4H_8$), isobutylene ($C_4H_8$), pentene ($C_5H_{10}$); as acetylenic hydrocarbons, acetylene ($C_2H_2$), methyl acetylene ($C_3H_4$), butyne ($C_4H_6$); and the like.

As the starting gas containing Si, C and H as constituent atoms, there may be mentioned alkyl silanes such as $Si(CH_3)_4$, $Si(C_2H_5)_4$ and the like. In addition to these starting gases, it is also possible as a matter of course to use $H_2$ as effective starting gas for introduction of $H_2$.

In the present invention, preferable halogen atoms (X) to be contained in the second amorphous layer (II) are F, Cl, Br and I. Particularly, F and Cl are preferred.

Incorporation of hydrogen atoms into the second amorphous layer (II) is convenient from aspect of production cost, because a part of starting gas species can be made common in forming continuous layers together with the first amorphous layer (I).

In the present invention, as the starting gas which can be used effectively for introduction of halogen atoms (X) in formation of the second amorphous layer (II), there may be mentioned gaseous substances under conditions of normal temperature and normal pressure or readily gasifiable substances.

Such starting gases for introduction of halogen atoms (X) may include single halogen substances, hydrogen halides, interhalogen compounds, silicon halides, halo-substituted silicon hydrides and the like.

More specifically, there may be mentioned, as single halogen substances, halogenic gases such as of fluorine, chlorine, bromine and iodine; as hydrogen halides, HF, HI, HCl, and HBr; as interhalogen compounds, BrF, ClF, $ClF_3$, $ClF_5$, BrF , $BrF_3$, $IF_7$, $IF_5$, ICl, IBr; as silicon halides, $SiF_4$, $Si_2F_6$, $SiCl_4$, $SiCl_3Br$, $SiCl_2Br_2$, $SiClBr_2$, $SiCl_3I$, $SiBr_4$; as halo-substituted silicon hydrides, $SiH_2F_2$, $SiH_2Cl_2$, $SiHCl_3$, $SiH_3Cl$, $SiH_3Br$, $SiH_2Br_2$, $SiHBr_3$ and the like.

In addition to these materials, there may also be employed halo-substituted paraffinic hydrocarbons such as $CCl_4$, $CHF_3$, $CH_2F_2$, $CH_3F$, $CH_3Cl$, $CH_3Br$, $CH_3I$, $C_2H_5Cl$ and the like, fluorinated sulfur compounds such as $SF_4$, $SF_6$ and the like, halo-containing alkyl silanes such as $SiCl(CH_3)_3$, $SiCl_2(CH_3)_2$, $SiCl_3CH_3$ and the like, as effective materials.

For formation of the second amorphous layer (II) according to the sputtering method, a single crystalline or polycrystalline Si wafer or C wafer or a wafer containing Si and C mixed therein is used as target and subjected to sputtering in an atmosphere of various gases.

For example, when Si wafer is used as target, a starting gas for introducing at least C, which may be diulted with a diluting gas, if desired, is introduced into a deposition chamber for sputtering to form a gas plasma therein and effect sputtering with said Si wafer.

Alternatively, Si and C as separate targets or one sheet target of a mixture of Si and C can be used and sputtering is effected in a gas atmosphere containing, if necessary, at least hydrogen atoms or halogen atoms.

As the starting gas for introduction of C or for introduction of H or X, there may be employed those as mentioned in the glow discharge as described above as effective gases also in case of the sputtering method.

In the present invention, as the diluting gas to be used in forming the second amorphous layer (II) by the glow discharge method or the sputtering method, there may be preferably employed so called rare gases such as He, Ne, Ar and the like.

The second amorphous layer (II) in the present invention should be carefully formed so that the required characterictics may be given exactly as desired.

That is, a substance containing as constituent atoms Si, C and, if necessary, H and/or X can take various forms from crystalline to amorphous, electrical properties from conductive through semi-conductive to insulating, and photoconductive properties from photoconductive to non-photoconductive depending on the preparation conditions. Therefore, in the present invention, the preparation conditions are strictly selected as desired so that there may be formed a-SiC(H,X) having desired characteristics depending on the purpose.

For example, when the second amorphous layer (II) is to be provided primarily for the purpose of improvement of dielectric strength, a-SiC(H,X) is prepared as an amorphous material having marked electric insulating behaviours under the usage conditions.

Alternatively, when the primary purpose for provision of the second amorphous layer (II) is improvement of continuous repeated use characteristics or environmental characteristics in use, the degree of the above electric insulating property may be alleviated to some extent and a-SiC(H,X) may be prepared as an amorphous material having sensitivity to some extent to the light irradiated.

In forming the second amorphous layer (II) comprising a-SiC(H,X) on the surface of the first amorphous layer (I), the support temperature during layer formation is an important factor having influences on the structure and the characteristics of the layer to be formed, and it is desired in the present invention to control severely the support temperature during layer formation so that a-SiC(H,X) having intended characteristics may be prepared as desired.

As the support temperature in forming the second amorphous layer (II) for accomplishing effectively the objects of the present invention, there may be selected suitably the optimum temperature range in conformity with the method for forming the second amorphous layer (II) in carrying out formation of the second amorphous layer (II).

When the second amorphous layer (II) is to be formed of a-$Si_aC_{1-a}$, the support temperature may preferably be 20° to 300° C., more preferably 20° to 250° C.

When the second amorphous layer (II) is to be formed of a-$(Si_bC_{1-b})_{1-c}$ or a-$(Si_dC_{1-d})_e(X,H)_{1-e}$, the support temperature may preferably be 50° to 350° C., more preferably 100° to 250° C.

For formation of the second amorphous layer (II), the glow discharge method or the sputtering method may be advantageously adopted, because sever control of the composition ratio of atoms constituting the layer or control of layer thickness can be conducted with relative case as compared with other methods. In case when the second amorphous layer (II) is to be formed according to these layer formation methods, the discharging power and the gas pressure during layer formation are important factors influencing the characteristics of a-SiC(H,X) to be prepared, similaarly as the aforesaid support temperature.

The discharging power condition for prepoaring effective a-$Si_aC_{1-a}$ having characteristics for acomplilshing the objects of the present invention with good productivity may preferably be 50 W to 250 W, most preferably 80 W to 150 W.

The discharging power condition, in case of a-$(Si_bC_{1-b})_cH_{1-c}$ and a-$(Si_dC_{1-d})_e(X,H)_{1-e}$, may preferably be 10 to 300 W, more preferably 20 to 200 W.

The gas pressure in a deposition chamber may preferably be about 0.01 to 5 Torr, more preferably about 0.01 to 1 Torr, more preferably about 0.1 to 0.5 Torr.

In the present invention, the above numerical ranges may be mentioned as preferable numerical ranges for the support temperature and discharging power, for preparation of the second amorphous layer (II). However, these factors for layer formation should not be determined separately independently of each other, but it is desirable that the optimum values of respective layer forming factors should be determined based on mutual organic relationship so that a second amorphous layer (II) comprising a-SiC(H,X) having desired characteristics may be formed.

The contents of carbon atoms and hydrogen atoms in the second amorphous layer (II) in the photoconductive member of the present invention are another important factor for obtaining the desired characteristics to accomplish the objects of the present invention, similarly as the conditions for preparation of the second amorphous layer (II).

The content of carbon atoms contained in the second amorphuos layer (II) in the present invention, when it is constituted of a-$Si_aC_{1-a}$, may be generally $1\times10^{-3}$ to 90 atomic %, preferably 1 to 80 atomic %, most preferably 10 to 75 atomic %. That is, in terms of the aforesaid representation a in the formula a-$Si_aC_{1-a}$, a may be generally 0.1 to 0.99999, preferably 0.2 to 0.99, most preferably 0.25 to 0.9.

When the second amorphous layer (II) is constituted of a-$(Si_bC_{1-b})_cH_{1-c}$, the content of carbon atoms contained in said layer (II) may be generally $1\times10^{-3}$ to 90 atomic %, preferably 1 to 90 atomic %, most preferably 10 to 80 atomic %. The content of hydrogen atoms may be generally 1 to 40 atomic %, preferably 2 to 35 atomic %, most preferably 5 to 30 atomic %. A photoconductive member formed to have a hydrogen atom content with these ranges is sufficiently applicable as an excellent one in practical applications. That is, in terms of the representation by a-$(Si_bC_{1-b})_cH_{1-c}$, b may be generally 0.1 to 0.99999, preferably 0.1 to 0.99, most preferably 0.15 to 0.9, and c generally 0.6 to 0.99, preferably 0.65 to 0.98, most preferably 0.7 to 0.95.

When the second amorphous layer (II) is constituted of a-$(Si_dC_{1-d})_e(X,H)_{1-e}$, the content of carbon atoms contained in said layer (II) may be generally $1\times10^{-3}$ to 90 atomic %, preferably 1 to 90 atomic %, most preferably 10 to 80 atomic %. The content of halogen atoms may be generally 1 to 20 atomic %, preferably 1 to 18 atomic %, most preferably 2 to 15 atomic %. A photoconductive member formed to have a halogen atom content with these ranges is sufficiently applicable as an excellent one in practical applications. The content of hydrogen atoms to be optionally contained may be generally up to 19 atomic %, preferably up to 13 atomic %. That is, in terms of the representation by a-$(Si_dC_{1-d})_e(X,H)_{1-e}$, e may be generally 0.1 to 0.99999, preferably 0.1 to 0.99, most preferably 0.15 to 0.9, and e generally 0.8 to 0.99, preferably 0.82 to 0.99, most preferably 0.85 to 0.98.

The range of the numerical value of layer thickness of the second amorphous layer (II) in the present invention is one of important factors for accomplishing effectively the objects of the present invention.

It is desirable that the range of the numerical value of layer thickness of the second amorphous layer (II) is suitably determined depending on the intended purpose so as to effectively accomplish the objects of the present invention.

The layer thickness of the second amorphous layer (II) is required to be determined as desired suitably with due considerations about the relationships with the contents of carbon atoms, hydrogen atoms or halogen atoms, the layer thickness of the first amorphous layer (I), as well as other organic relationships with the characteristics required for respective layer regions. In addition, it is also desirable to have considerations from economical point of view such as productivity or capability of mass production.

The second amorphous layer (II) in the present invention is desired to have a layer thickness generally of 0.003 to 30μ, preferably 0.004 to 20μ, most preferably 0.005 to 10μ.

An outline of the preparation method for the formation of a photosensitive member according to a glow discharging decomposition will be explained in the following.

Figure 12:
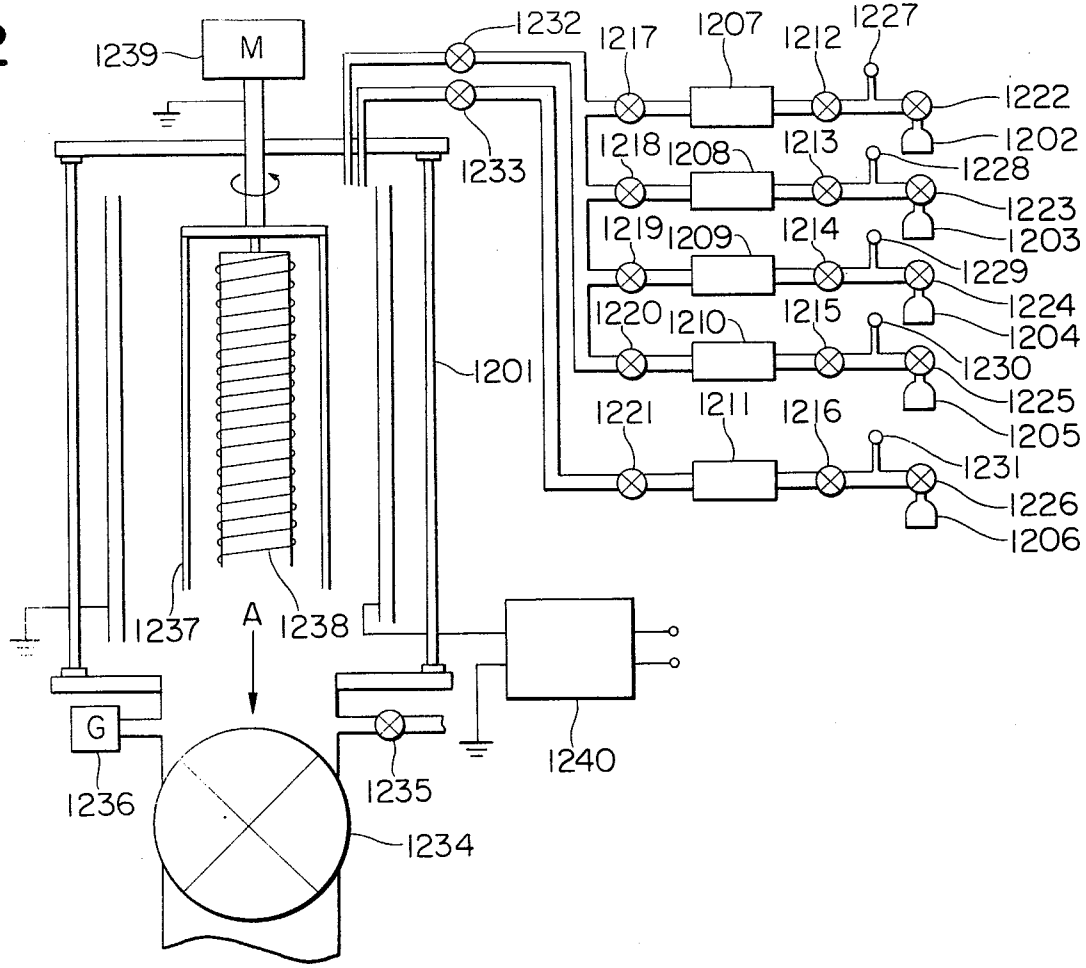
FIG. 12 and FIG. 13 are the illustrative drawings of the view of the apparatuses which may be used for producing the photoconductive member in this invention.

FIG. 12 illustrates an apparatus capable of producing the photoconductive member by a glow discharging decomposition method.

In the gas bombs 1202–1206, there are hermetically contained starting gases for the formation of respective layers of the present invention. For example, 1202 is a bomb containing $SiH_4$ gas duluted with He (purity: 99.999%, hereinafter abbreviated as $SiH_4$/He), 1203 is a bomb containing $B_2H_6$ gas diluted with He (purity: 99.999%, hereinafter abbreviated as $B_2H_6$/He), 1204 is a bomb containing $Si_2H_6$ gas diluted with He (purity: 99.99%, hereinafter abbreviated as $Si_2H_6$/He), 1205 is a bomb containing NO gas (purity: 99.999%), and 1206 is a bomb containing $SiF_4$ gas diluted with He (purity: 99.999%) (hereinafter abbreviated as $SiF_4$/He)

For allowing these gases to flow into the reaction chamber 1201, on conformation of the valves 1222–1226 of the gas bombs 1202–1206 and the leak valve 1235 to be closed, and the inflow valves 1212–1216, the outflow valves 1217–1221 and the auxiliary valve 1232, 1233 to be opened, the main valve 1234 is first opened to evacuate the reaction chamber 1201 and the gas pipelines. As the next step, when the reading on the vacuum indicator 1236 becomes about $5\times10^{-6}$ Torr, the auxiliary valves 1232 and 1233, and outflow valves 1217–1221 are closed.

Next, an example of forming a photoconductive member having an amorphous layer having such a structure as shown in FIG. 1 overlying the cylinderlike substrate 1237 will be described below.

$SiH_4$/He gas from bomb 1202, $B_2H_6$/He gas from bomb 1203 and NO gas from bomb 1205 are permitted to flow into mass-flow controllers 1207, 1208 and 1210 by opening valves 1222, 1223 and 1225 to control outlet pressure gauges 1227, 1228 and 1230 to 1 kg/cm$^2$ amd opening gradually inflow valves 1212, 1213 and 1215, respectively. Then, outflow valves 1217, 1218 and 1220 and auxiliary valve 1232 are gradually opened to permit the respective gases to flow into reaction chamber 1201. Outflow valves 1217, 1218 and 1220 are controlled so that the flow rate ratio of $SiH_4$/He gas:$B_2H_6$/He gas: NO gas may have a desired value, and opening degree of main valve 1234 is also controlled watching the reading of vacuum indicator 1236 so that the pressure in the reaction chamber 1201 may reach a desired value. Then after confirming that the temperature of the substrate cylinder 1237 has reached to 50°-400° C. by a heater 1238, a power source 1240 is set at a desired output to cause glow discharging in the reaction chamber 1201, simultaneously the opening degree of the valve 1220 is gradually adjusted to regulate the NO gas flowing rate by means of hand operation or outer driving motor or the like according to the indication from the predesigned relation curves so as to control the distirbution concentration in the direction of the thickness of oxygen atoms to be contained in the layer to be formed.

After the formation of the layer region (B, O) has been completed so that said region (B, O) may contain boron atoms and oxygen atoms in the layer as desired thickness according to the above procedure, the subsequent layer formation may be further advanced under the same conditions as the foregoing except that the introduction of $B_2H_6$/He gas and NO gas into the reaction chamber 1201 is stopped by closing the outflow valves 1218 and 1220 and thereby a layer region containing neither oxygen atoms nor boron atoms and having a desired layer thickness is formed on the layer region (B, O). According to the above procedure, an amorphous layer having desired characteristics is formed on the substrate 1237.

The layer region (III) contaiing boron atoms may be formed in a desired thickness by intercepting the inflow of $B_2H_6$/He gas into the reaction chamber 1201 at a proper time during the forming step for the amorphous layer. It is possible to form a layer structure that the layer region (III) occupies the whole layer region of the layer region (O) or a part thereof.

In above embodiment, for example, after the layer region (B, O) has been formed in a desired thickness, the subsequent layer formation is advanced further under the same conditions as the foregoing except that the introduction of NO gas into the reaction chamber 1201 is stopped by closing wholly the outflow valve 1220 and thereby there can be formed, as a part of the amorphous layer, a layer region containing boron atom, but not oxygen atom on the layer region (B, O).

On the other hand, the formation of a layer region containing no boron atoms, but oxygen atoms, can be effected, for example, by using NO gas and $SiH_4$/He gas.

In the case of introducing halogen atoms into an amorphous layer, for example, $SiF_4$/He is further added to the abovementioned gas and then introduced into reaction chamber 1201.

All the outflow valves other than those for gases necessary for formation of respective layers are, of course, closed, and during formation of respective layers, in order to avoid remaining of the gas used in the precedent layer in the reaction chamber 1201 and pipelines from the outflow valves 1217-1221 to the reaction chamber 1201, there may be conducted the procedure comprising once evacuating to a high vacuum the system by closing the outflow valves 1217-1221 and opening the auxiliary valve 1232 and 1233 with full opening of the main valve 1234, if necessary.

During formation of the layer, the substrate 1237 may be rotated at a constant speed by means of a motor 1239 in order to effect a uniform layer formation.

Figure 13:
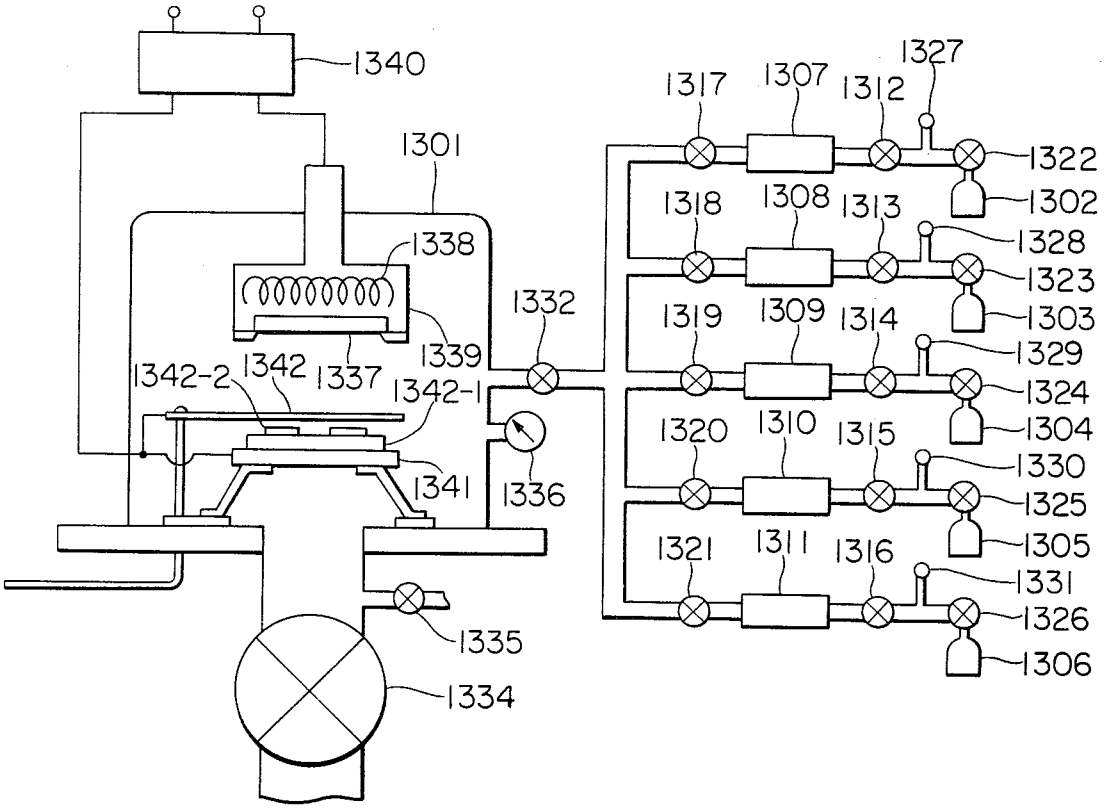

The production apparatus of FIG. 13 is an alternative example of an apparatus.

In gas bombs 1302-1306, there are hermicically contained starting gases for producing respective layer regions of the present invention. For example, bomb 1302 contains $SiH_4$/He gas, bomb 1303 contains $B_2H_6$/He gas, bomb 1304 contains Ar gas (purity: 99.99%), bomb 1305 contains NO gas (purity: 99.999%), and bomb 1306 contains $SiF_4$/He gas.

For allowing these gases to flow into the reaction chamber 1301, on confirmation of the valves 1322-1326 of the gas bombs 1302-1306 and the leak valve 1335 to be closed, and the inflow valves 1312-1316, the outflow valves 1317-1321 and the auxiliary valve 1332 to be opened, the main valve 1334 is first opened to evacuate the reaction chamber 1301 and the gas pipelines. As the next step, when the reading on the vacuum indicator 1336 becomes about $5\times10^{-6}$ Torr, the auxiliary valves 1332, and outflow valves 1317-1321 are closed.

As the next, an example of forming a photoconductive member having such a layer constitution as shown in FIG. 11 overlying a substrate 1337 will be described below.

$SiH_4$/He gas from bomb 1302, $B_2H_6$/He gas from bomb 1303 and NO gas from bomb 1305 are permitted to flow into mass-flow controllers 1307, 1308 and 1310 by opening valves 1322, 1323 and 1325 to control outlet pressure gauges 1327, 1328 and 1330 to 1 kg/cm$^2$ and opening gradually inflow valves 1312, 1313 and 1315, respectively. Then outflow valves 1317, 1318 and 1320 and auxiliary valve 1332 are gradually opened to permit the respective gases to flow into reaction chamber 1301. Outflow valves 317. 1318 and 1320 are controlled so that the flow rate ratio of $SiH_4$/He gas: $B_2H_6$/He gas: NO gas may have a desired value, and opening degree of main valve 1334 is also controlled watching the reading of vacuum indicator 1336 so that the pressure in the reaction chamber 1301 may reach a desired value. Then after confirming that the temperature of the substrate 1337 has reached to 50°-400° C. by a heater 1338, a power source 1340 is set at a desired output to cause glow discharging in the reaction chamber 1301, simultaneously the opening degree of the valve 1320 is gradually adjusted to regulate the NO gas flowing rate by means of hand operation or outer driving motor and the like according to the indication from the predesigned relation curves to control the distribution concentration in the direction of the thickness of oxygen atoms to be contained in the layer to be formed.

When the formation of the layer region (B, O) containing boron atom and oxygen atom has been completed according to the above procedure, the layer formation may be further advanced under the same conditions as the foregoing except that the introduction of $B_2H_6$/He gas and NO gas into the reaction chamber 1301 is intercepted by closing the outflow valves 1318 and 1320, and thereby, there is formed a layer region containing neither oxygen atom nor boron atom and having a desired layer thickness on the layer region (B, O). According to above procedure, the first amorphous layer (I) having desired characteristics can be formed on the substrate 1337.

The layer region (III) containing boron atoms may be formed in a desired thickness by intercepting the inflow of $B_2H_6$/He gas into the reaction chamber 1301 at a proper time during forming the first amorphous layer (I), and it is possible to form the layer region (III) occupying a part or the whole region of the layer region (O).

In the above embodiment, for example, when the layer region (B, O) has been formed in a desired thickness, the layer formation is advanced further under the same conditions as the foregoing except that the introduction of NO gas into the reaction chamber 1301 is stopped by closing wholly the outflow valve 1320, and thereby a layer region containing boron atom, but not oxygen atom as a part of the first amorphous layer (I) on the layer region (B, O).

On the other hand, a layer region containing no boron atom, but oxygen atom, may be produced by using, for example, NO gas together with $SiH_4$/He gas.

For producing a first amorphous layer (I) containing halogen atom, for example, $SiF_4$/He in addition to the above gases is introduced into the reaction chamber 1301.

A second amorphous layer (II) may be formed on the first amorphous layer (I) as shown below.

Shutter 1342 is opened, and all gas feeding valves are once closed and reaction chamber 1301 is evacuated by fully opening main valve 1334. High purity silicon wafer 1342-1 and high purity graphite wafer 1342-2 are placed as targets on an electrode 1341 to which a high voltage power is applied, at a desired area ratio. From bomb 1304, Ar gas is introduced into reaction chamber 1301, and main valve 1334 is controlled so that the inner pressure of the reaction chamber 1301 may become 0.05–1 Torr. The high voltage power source 1340 is switched on to effect sputtering with the above targets. As a result, the second amorphous layer (II) is formed on the first amorphous layer (I).

The amount of carbon atoms contained in the second amorphous layer (II) may be controlled as required by means of adjusting the sputtering area ratio of silicon wafer 1342-1 to graphite wafer 1342-2 or the mixing ratio of silicon powder to graphite powder when a target is formed in accordance with a desire.

All the outflow valves other than those for gases necessary for formation of respective layers are, of course, closed, and during formation of respective layers, in order to avoid remaining of the gases used in the precedent layer in the reaction chamber 1301 and pipelines from the outflow valves 1317–1321 to the reaction chamber 1301, there may be conducted the procedure comprising once evacuating to a high vacuum the system by closing the outflow valves 1317–1321 and opening the auxiliary valve 1332 with full opening of the main valve 1334, if necessary.

A photoconductive member which is designed as described above specifically can solve all the problems cited in the foregoing and may exhibit markedly excellent electrical, optical and photoconductive characteristics, dielectric strength and environmental characteristics in use.

In particular, when it is used as an image forming member for electrophotography, the image forming member is entirely free from residual potentials for image forming, constantly stable in electrical characteristics, high in photosensitivity, high in SN ratio, markedly excellent in light fatigue resistance and excellent in characteristics for repeated uses, and can repeatedly produce images of high quality, high density, clear half-tone, and high resolution.

EXAMPLE 1

Figure 14:
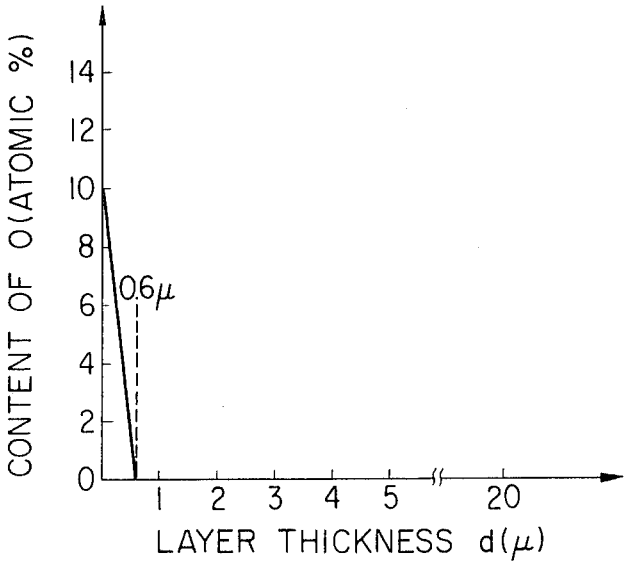
FIGS. 14 through 16 are the illustrative drawings to show the distribution of the oxygen atoms for the examples according to this invention.

By using the apparatus in FIG. 12, an image forming member having a first layer having the concentration distribution of oxygen as shown in FIG. 14 was produced under the conditions of Table 1A.

The resulting image forming member was set in a charging-exposing experimental device, and subjected to corona charging at ⊕ 5 KV for 0.2 sec. followed immediately by imagewise exposure at 1.5 lux.sec. through a transparent test chart with a tungsten lamp as a light source.

Immediately thereafter, the surface of the member was subjected to cascading of a ⊖ charged developer (including toner and carrier) to produce good toner images on the surface of the member.

The resulting toner images on the surface of the member was transferred to an image receiving paper by corona charging at ⊕ 5.0 KV. The images thus transferred were of excellent resolution, good tone reproducibility, high sharpness and high density.

EXAMPLE 2

Figure 15:
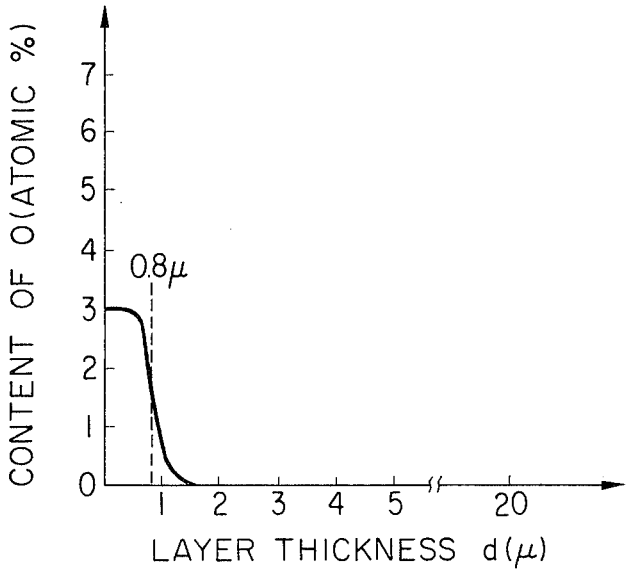

By means of the preparation apparatus as shown in FIG. 12, an image forming member having such a concentration distribution of oxygen in the first and second layers as shown in FIG. 15 was formed under the conditions in Table 2A. The other conditions were the same as those in Example 1.

By using the resulting image forming member and repeating the procedure of Example 1, images were formed on an image receiving paper by transferring. The images are of sharp image quality.

EXAMPLE 3

Figure 16:
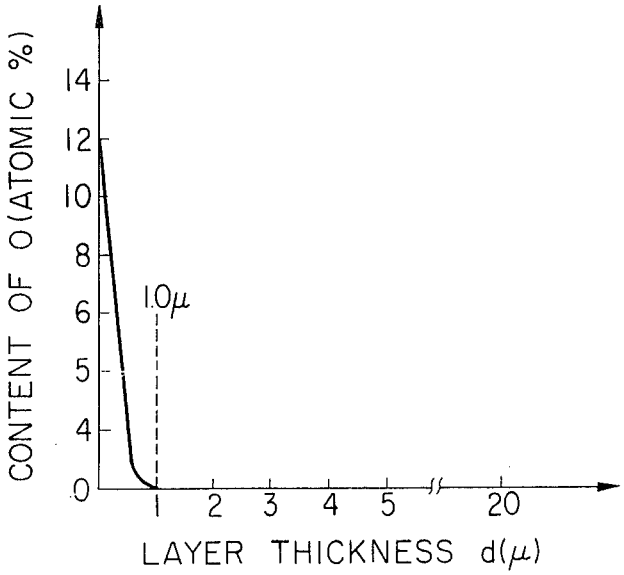

By means of the preparation apparatus as shown in FIG. 12, an image forming member having such a concentration distribution of oxygen in the first layer as shown in FIG. 16 was formed under the conditions in Table 3A. The other conditions were the same as those in Example 1.

By using the resulting image forming member and employing the procedure and conditions of Example 1, images were formed on an image receiving paper by transferring. The resulting images were very sharp and clear.

EXAMPLE 4

According to the entirely same procedure as that in Example 1 except for modifying the content of boron atoms in the first layer by varying the flow rate ratio of $B_2H_6$ to $SiH_4$ upon forming the first layer, image forming members were formed. Evaluation of the quality of each of the transferred images for respective image forming members thus obtained was performed as in Example 1. The results are shown in Table 4A.

EXAMPLE 5

According to the same procedure as that in Example 1 except for fixing the whole layer thickness to be formed on the image forming member to 10μ and modifying relatively the ratio of the layer thickness of the first layer to the second layer, image forming members were formed. Evaluation was effected as in Example 1. The results are shown in Table 5A.

EXAMPLE 6

By repeating the procedures of Example 1 except that the first and the second layers were produced under the conditions in Table 6A, a layer formation was effected. Image evaluation was conducted as in Example 1. Good result was obtained.

EXAMPLE 7

By using the apparatus in FIG. 13, an image forming member having a first and a second layers having the concentration distribution of oxygen as shown in FIG. 14 was produced under the conditions of Table 1B.

The resulting image forming member was set in a charging-exposing experimental device, and subjected to corona charging at ⊕ 5 KV for 0.2 sec. followed immediately by imagewise exposure at 1.5 lux.sec. through a transparent test chart with a tungsten lamp as a light source.

Immediately thereafter, the surface of the member was subjected to cascading of a ⊖ charged developer (including toner and carrier) to produce good toner images on the surface of the member.

The resulting toner images on the surface of the member was transferred to an image receiving paper by corona charging at ⊕ 5.0 KV. The images thus transferred were of excellent resolution, good tone reproducibility, high sharpness and high density.

EXAMPLE 8

By means of the preparation apparatus as shown in FIG. 13, an image forming member having such a concentration distribution of oxygen in the first and the second layers as shown in FIG. 15 was formed under the conditions as indicated in Table 2B. The other conditions were the same as those in Example 7.

The resulting image forming member was subjected to the image forming procedure under the conditions as in Example 7 to produce images on an image receiving paper by transferring. The resulting images were very clear and sharp.

EXAMPLE 9

By means of the preparation apparatus as shown in FIG. 13, an image forming member having such a concentration distribution of oxygen in the first layer as shown in FIG. 16 was formed under the conditions as indicated in Table 3B. The other conditions were the same as those in Example 7.

By using the resulting image forming member under the conditions of and following the procedure of Example 7, very sharp and clear images were formed on an image receiving paper.

EXAMPLE 10

According to the same procedure as that in Example 9 except for modifying the content ratio of silicon atoms to carbon atoms in an amorphous layer (II) by varying the area ratio of silicon wafer to graphite wafer at the formation of said amorphous layer (II), an image forming member was formed.

The resulting image forming member was subjected to image formation, development and cleaning steps as in Example 7 about 50,000 times, and image evaluation was effected. The results are shown in Table 4B.

EXAMPLE 11

According to the entirely same procedure as that in Example 7 except for modifying the layer thickness of an amorphous layer (II), the image forming members were formed.

By repeating the image forming, developing and cleaning steps as in Example 7, there were obtained the results as shown in Table 5B.

EXAMPLE 12

According to the same procedure as that in Example 7 except for modidying the layer forming conditions for the first and the second layers as shown in Table 6B, layer formation was effected. Image evaluation as in Example 7 gave good results.

EXAMPLE 13

By using the apparatus in FIG. 13, an image forming member having a first and a second layers having the concentration distribution of oxygen as shown in FIG. 14 was produced under the conditions of Table 1C.

The resulting image forming member was set in a charging-exposing experimental device, and subjected to corona charging at ⊕ 5 KV for 0.2 sec. followed immediately by imagewise exposure at 1.5 lux.sec. through a transparent test chart with a tungsten lamp as a light source.

Immediately thereafter, the surface of the member was subjected to cascading of a ⊖ charged developer (including toner and carrier) to produce good toner images on the surface of the member.

The resulting toner images on the surface of the member was transferred to an image receiving paper by corona charging at ⊕ 5.0 KV. The images thus transferred were of excellent resolution, good tone reproducibility, high sharpness and high density.

EXAMPLE 14

By means of the preparation apparatus as shown in FIG. 13, an image forming member having such a concentration distribution of oxygen in the first and the second layers as shown in FIG. 15 was formed under the conditions as indicated in Table 2C.

By using the resulting image forming member under the conditions of and following the procedure of Example 13, very sharp and clear images were formed on an image receiving paper.

EXAMPLE 15

By means of the preparation apparatus as shown in FIG. 13 an image forming member having such a concentration distribution of oxygen in the first layer as shown in FIG. 16 was formed under the conditions as indicated in Table 3C. The other conditions were the same as those in Example 13.

By using the resulting image forming member under the conditions of and following the procedure of Example 13, very sharp and clear images were formed on an image receiving paper.

EXAMPLE 16

According to the entirely same procedure as that in Example 13 except for modifying the content ratio of silicon atoms to carbon atoms in an amorphous layer (II) by varying the gas flow rate ratio of $SiH_4$ gas to $C_2H_4$ gas at the formation of said amorphous layer (II), image forming members were formed.

The resulting photosensitive drum was subjected to the steps up to transferring as in Example 13 about 50,000 times. The image evaluation results are shown in Table 4C.

EXAMPLE 17

By repeating the procedure of Example 13 except for modifying the layer thicknesses of an amorphous layer (II) as in Table 5C, the layer formation was effected. Evaluation results are shown in Table 5C.

EXAMPLE 18

By repeating the procedure of Example 13 except for modifying the forming conditions for the first and the second layers as shown in Table 6C, the layer formation was effected. Evaluation of the image was effected as in Example 13. The results were satisfactory.

EXAMPLE 19

By using the apparatus in FIG. 13, an image forming member having a first and a second layers having the concentration distribution of oxygen as shown in FIG. 14 was produced under the conditions of Table 1D.

The resulting image forming member was set in a charging-exposing experimental device, and subjected to corona charging at ⊕ 5 KV for 0.2 sec. followed immediately by imagewise exposure at 1.5 lux.sec. through a transparent test chart with a tungsten lamp as a light source.

Immediately thereafter, the surface of the member was subjected to cascading of a ⊖ charged developer (including toner and carrier) to produce good toner images on the surface of the member.

The resulting toner images on the surface of the member was transferred to an image receiving paper by corona charging at ⊕ 5.0 KV. The images thus transferred were of excellent resolution, good tone reproducibility, high sharpness and high density.

EXAMPLE 20

By means of the preparation apparatus in FIG. 13, an image forming member having such a concentration distribution of oxygen in the first and the second layers as shown in FIG. 15 was formed under the conditions as indicated in Table 2D. The other conditions were as those in Example 19.

Images were formed on an image receiving paper under the same conditions and by the same procedure as in Example 19 with the resulting image forming member. The resulting images were of very clear and sharp image quality.

EXAMPLE 21

By means of the preparation apparatus as shown in FIG. 13, an image forming member having such a concentration distribution of oxygen in the first layer as shown in FIG. 16 was formed under the conditions as indicated in Table 3D. The other conditions were the same as those in Example 19.

By using the resulting image forming member and following the conditions and procedure of Example 19, images were formed on an image receiving paper by transferring. Very clear and sharp images were produced.

EXAMPLE 22

According to the entirely same procedure as that in Example 19 except for modifying the content ratio of silicon atoms to carbon atoms in an amorphous layer (II) by varying the gas flow rate ratio, $SiH_4$ gas : $SiF_4$ gas : $C_2H_4$ gas at the formation of said amorphous layers (II), the image forming member was formed.

The resulting image forming member was subjected to the steps of image formation, development and cleaning as shown in Example 19 about 50,000 times, and image evaluation was effected. The results are shown in Table 4D.

EXAMPLE 23

According to the entirely same procedure as that in Example 19 except for modifying the layer thickness of the amorphous layer (II), an image forming member was formed.

The steps of image forming, developing and cleaning as described in Example 19 were repeated. The results are shown in Table 5D.

EXAMPLE 24

According to the similar procedure as that in Example 19 except for modifying the forming conditions for the first and the second layers as shown in Table 6D, the layer formation was effected. Image quality evaluation was effected as in Example 19. The result was satisfactory.

TABLE 1A

| Layer constitution | Gas employed | Flow rate (SCCM) | Flow rate ratio | Discharge power ($W/cm^2$) | Layer formation rate (Å/sec) | Layer thickness (μ) |
|---|---|---|---|---|---|---|
| First layer | $SiH_4/He = 0.5$<br>NO<br>$B_2H_6/He = 10^{-3}$ | $SiH_4 = 200$ | $NO/SiH_4 = 1 \times 10^{-1} \sim 0$<br>$B_2H_6/SiH_4 = 4 \times 10^{-3}$ | 0.18 | 15 | 0.6 |
| Second layer | $SiH_4/He = 0.5$ | $SiH_4 = 200$ | | 0.18 | 15 | 20 |

Al support temperature: 250° C.
Discharge frequency: 13.56 MHz
Inner pressure upon reaction: 0.5 Torr

TABLE 2A

| Layer constitution | Gas employed | Flow rate (SCCM) | Flow rate ratio | Discharge power ($W/cm^2$) | Layer formation rate (Å/sec) | Layer thickness (μ) |
|---|---|---|---|---|---|---|
| First layer | $SiH_4/He = 0.5$<br>NO<br>$B_2H_6/He = 10^{-3}$ | $SiH_4 = 200$ | $NO/SiH_4 = 3 \times 10^{-2} \sim 2 \times 10^{-2}$<br>$B_2H_6/SiH_4 = 2 \times 10^{-3}$ | 0.18 | 15 | 0.8 |
| Second layer | $SiH_4/He = 0.5$<br>NO | $SiH_4 = 200$ | $NO/SiH_4 = 2 \times 10^{-2} \sim 0$ | 0.18 | 15 | 0.7 |
| Third layer | $SiH_4/He = 0.5$ | $SiH_4 = 200$ | | 0.18 | 15 | 20 |

TABLE 3A

| Layer constitution | Gas employed | Flow rate (SCCM) | Flow rate ratio | Discharge power ($W/cm^2$) | Layer formation rate (Å/sec) | Layer thickness ($\mu$) |
|---|---|---|---|---|---|---|
| First layer | $SiH_4/He = 0.5$<br>NO<br>$B_2H_6/He = 10^{-3}$ | $SiH_4 = 200$ | $NO/SiH_4 = 1.2 \times 10^{-1} \sim 0$<br>$B_2H_6/SiH_4 = 1.5 \times 10^{-3}$ | 0.18 | 15 | 1.0 |
| Second layer | $SiH_4/He = 0.5$ | $SiH_4 = 200$ | | 0.18 | 15 | 20 |

TABLE 4A

| Sample No. | 401A | 402A | 403A | 404A | 405A |
|---|---|---|---|---|---|
| B/Si (Content ratio) | $5 \times 10^{-4}$ | $1 \times 10^{-3}$ | $3 \times 10^{-3}$ | $6 \times 10^{-3}$ | $1 \times 10^{-2}$ |
| Image quality evaluation | ○ | ◎ | ◎ | ◎ | ○ |

◎Very good
○Good

TABLE 5A

| Sample No. | 501A | 502A | 503A | 504A | 505A | 506A |
|---|---|---|---|---|---|---|
| Thickness of first layer/ Thickness of second layer | 1/200 | 1/50 | 1/20 | 1/5 | 1/2 | 1/1 |
| Image quality evaluation | ○ | ◎ | ◎ | ◎ | ◎ | ○ |

◎Very good
○Good

TABLE 6A

| Layer constitution | Gas employed | Flow rate (SCCM) | Flow rate ratio | Discharge power ($W/cm^2$) | Layer formation rate (Å/sec) | Layer thickness ($\mu$) |
|---|---|---|---|---|---|---|
| First layer | $SiH_4/He = 0.5$<br>$SiF_4/He = 0.5$<br>NO<br>$B_2H_6/He = 10^{-3}$ | $SiH_4 +$<br>$SiF_4 = 200$ | $NO/SiH_4/SiF_4 =$<br>$1 \times 10^{-1} 10.5/0.05 \sim$<br>$0/0.5/0.5$<br>$B_2H_6/(SiH_4 +$<br>$SiF_4) = 4 \times 10^{-3}$ | 0.18 | 15 | 0.6 |
| Second layer | $SiH_4/He = 0.5$<br>$SiF_4/He = 0.5$ | $SiH_4 +$<br>$SiF_4 = 200$ | $SiH_4/SiF_4 = 1$ | 0.18 | 15 | 20 |

TABLE 1B

| Layer constitution | | Gas employed | Flow rate (SCCM) | Flow rate ratio | Discharge power ($W/cm^2$) | Layer formation rate (Å/sec) | Layer thickness ($\mu$) |
|---|---|---|---|---|---|---|---|
| Amorphous layer (I) | First layer | $SiH_4/He = 0.5$<br>NO<br>$B_2H_6/He = 10^{-3}$ | $SiH_4 = 200$ | $NO/SiH_4 = 1 \times 10^{-1} \sim 0$<br>$B_2H_6/SiH_4 = 4 \times 10^{-3}$ | 0.18 | 15 | 0.6 |
| | Second layer | $SiH_4/He = 0.5$ | $SiH_4 = 200$ | | 0.18 | 15 | 20 |
| Amorphous layer (II) | | Ar | 200 | Area ratio<br>Si wafer:Graphite = 1.5:8.5 | 0.3 | 2 | 0.3 |

Al support temperature: 250° C.
Discharge frequency: 13.56 MHz
Inner pressure upon reaction: 0.5 Torr

TABLE 2B

| Layer constitution | | Gas employed | Flow rate (SCCM) | Flow rate ratio | Discharge power ($W/cm^2$) | Layer formation rate (Å/sec) | Layer thickness ($\mu$) |
|---|---|---|---|---|---|---|---|
| Amorphous layer (I) | First layer | $SiH_4/He = 0.5$<br>NO<br>$B_2H_6/He = 10^{-3}$ | $SiH_4 = 200$ | $NO/SiH_4 =$<br>$3 \times 10^{-2} \sim 2 \times 10^{-2}$<br>$B_2H_6/SiH_4 = 2 \times 10^{-3}$ | 0.18 | 15 | 0.8 |
| | Second layer | $SiH_4/He = 0.5$<br>NO | $SiH_4 = 200$ | $NO/SiH_4 = 2 \times 10^{-2} \sim 0$ | 0.18 | 15 | 20 |
| | Third layer | $SiH_4/He = 0.5$ | $SiH_4 = 200$ | | 0.18 | 15 | 20 |
| Amorphous layer (II) | | Ar | 200 | Area ratio<br>Si wafer:Graphite = 1.5:9.5 | 0.3 | 1.5 | 0.3 |

TABLE 3B

| Layer constitution | | Gas employed | Flow rate (SCCM) | Flow rate ratio | Discharge power (W/cm²) | Layer formation rate (Å/sec) | Layer thickness (μ) |
|---|---|---|---|---|---|---|---|
| Amorphous layer (I) | First layer | $SiH_4/He = 0.5$<br>NO<br>$B_2H_6/He = 10^{-3}$ | $SiH_4 = 200$ | $NO/SiH_4 = 1.2 \times 10^{-1} \sim 0$<br>$B_2H_6/SiH_4 = 1.5 \times 10^{-3}$ | 0.18 | 15 | 1.0 |
| | Second layer | $SiH_4/He = 0.5$ | $SiH_4 = 200$ | | 0.18 | 15 | 20 |
| Amorphous layer (II) | | Ar | 200 | Area ratio<br>Si wafer:graphite<br>6:4 | 0.3 | 3 | 1.0 |

TABLE 4B

| Sample No. | 401B | 402B | 403B | 404B | 405B | 406B | 407B |
|---|---|---|---|---|---|---|---|
| Si:C Target (Area ratio) | 9:1 | 6.5:3.5 | 4:6 | 2:8 | 1:9 | 0.5:9.5 | 0.2:9.8 |
| Si:C (Content ratio) | 9.7:0.3 | 8.8:1.2 | 7.3:2.7 | 4.8:5.2 | 3:7 | 2:8 | 0.8:9.2 |
| Image quality evaluation | Δ | ○ | ◎ | ◎ | ○ | Δ | × |

◎ Very good
○ Good

TABLE 5B

| Sample No. | Thickness of amorphous layer (II) (μ) | Result |
|---|---|---|
| 501B | 0.001 | Liable to form defective images |
| 502B | 0.02 | Sometimes defective images are formed when repeated 20,000 times |
| 503B | 0.05 | Stable when repeated 50,000 times or more |
| 504B | 0.3 | Stable when repeated 100,000 times or more |

TABLE 6B

| Layer constitution | | Gas employed | Flow rate (SCCM) | Flow rate ratio | Discharge power (W/cm²) | Layer formation rate (Å/sec) | Layer thickness (μ) |
|---|---|---|---|---|---|---|---|
| Amorphous layer (I) | First layer | $SiH_4/He = 0.5$<br>$SiF_4/He = 0.5$<br>NO<br>$B_2H_6/He = 10^{-3}$ | $SiH_4 + SiF_4 = 200$ | $NO/SiH_4/SiF_4 = 1 \times 10^{-1}/0.5/0.5 \sim 0/0.5/0.5$<br>$B_2H_6/(SiH_4 + SiF_4) = 4 \times 10^{-3}$ | 0.18 | 15 | 0.6 |
| | Second layer | $SiH_4/He = 0.5$<br>$SiF_4/He = 0.5$ | $SiH_4 + SiF_4 = 200$ | $SiH_4/SiF_4 = 1$ | 0.18 | 15 | 20 |

TABLE 1C

| Layer constitution | | Gas employed | Flow rate (SCCM) | Flow rate ratio | Discharge power (W/cm²) | Layer formation rate (Å/sec) | Layer thickness (μ) |
|---|---|---|---|---|---|---|---|
| Amorphous layer (I) | First layer | $SiH_4/He = 0.5$<br>NO<br>$B_2H_6/He = 10^{-3}$ | $SiH_4 = 200$ | $NO/SiH_4 = 1 \times 10^{-1} \sim 0$<br>$B_2H_6/SiH_4 = 4 \times 10^{-3}$ | 0.18 | 15 | 0.6 |
| | Second layer | $SiH_4/He = 0.5$ | $SiH_4 = 200$ | | 0.18 | 15 | 20 |
| Amorphous layer (II) | | $SiH_4/He = 0.5$<br>$C_2H_4$ | $SiH_4 = 50$ | $SiH_4:C_2H_4 = 3:7$ | 0.18 | 6 | 0.5 |

Al support temperature: 250° C.
Discharge frequency: 13.56 MHz
Inner pressure upon reation: 0.5 Torr Δ Sufficiently practically usable
× Liable to form defective images

TABLE 2C

| Layer constitution | | Gas employed | Flow rate (SCCM) | Flow rate ratio | Discharge power (W/cm²) | Layer formation rate (Å/sec) | Layer thickness (μ) |
|---|---|---|---|---|---|---|---|
| Amorphous layer (I) | First layer | $SiH_4/He = 0.5$<br>NO<br>$B_2H_6/He = 10^{-3}$ | $SiH_4 = 200$ | $NO/SiH_4 = 3 \times 10^{-2} \sim 2 \times 10^{-2}$<br>$B_2H_6/SiH_4 = 2 \times 10^{-3}$ | 0.18 | 15 | 0.8 |
| | Second layer | $SiH_4/He = 0.5$<br>NO | $SiH_4 = 200$ | $NO/SiH_4 = 2 \times 10^{-2} \sim 0$ | 0.18 | 15 | 2.0 |
| | Third layer | $SiH_4/He = 0.5$ | $SiH_4 = 200$ | | 0.18 | 15 | 20 |

TABLE 2C-continued

| Layer constitution | Gas employed | Flow rate (SCCM) | Flow rate ratio | Discharge power ($W/cm^2$) | Layer formation rate (Å/sec) | Layer thickness (μ) |
|---|---|---|---|---|---|---|
| Amorphous layer (II) | $SiH_4/He = 1$ $C_2H_4$ | $SiH_4 = 15$ | $SiH_4:C_2H_4 =$ 0.9:9.6 | 0.18 | 15 | 0.3 |

TABLE 3C

| Layer constitution | | Gas employed | Flow rate (SCCM) | Flow rate ratio | Discharge power ($W/cm^2$) | Layer formation rate (Å/sec) | Layer thickness (μ) |
|---|---|---|---|---|---|---|---|
| Amorphous layer (I) | First layer | $SiH_4/He = 0.5$ NO $B_2H_6/He = 10^{-3}$ | $SiH_4 = 200$ | $NO/SiH_4 = 1.2 \times 10^{-1} \sim 0$ $B_2H_6/SiH_4 = 1.5 \times 10^{-3}$ | 0.18 | 15 | 1.0 |
| | Second layer | $SiH_4/He = 0.5$ | $SiH_4 = 200$ | | 0.18 | 15 | 20 |
| Amorphous layer (II) | | $SiH_4/He = 0.5$ $C_2H_4$ | $SiH_4 = 100$ | $SiH_4:C_2H_4 =$ 5:5 | 0.18 | 8 | 1.5 |

TABLE 4C

| Sample No. | 401C | 402C | 403C | 404C | 405C | 406C | 407C | 408C |
|---|---|---|---|---|---|---|---|---|
| $SiH_4:C_2H_4$ (Flow rate ratio) | 9:1 | 6:4 | 4:6 | 2:8 | 1:9 | 0.5:9.5 | 0.35:9.65 | 0.2:9.8 |
| Si:C (Content ratio) | 9:1 | 7:3 | 5.5:4.5 | 4:6 | 3:7 | 2:8 | 1.2:8.8 | 0.8:9.2 |
| Image quality evaluation | Δ | ○ | ◎ | ◎ | ◎ | ○ | Δ | × |

◎Very good
Δ Sufficiently practically usable
○ Good
× Somewhat defect images are formed.

TABLE 5C

| Sample No. | Thickness of amorphous layer (II) (μ) | Result |
|---|---|---|
| 501C | 0.001 | Liable to form defective images |
| 502C | 0.02 | No defective image formed when repeated 20,000 times |

TABLE 5C-continued

| Sample No. | Thickness of amorphous layer (II) (μ) | Result |
|---|---|---|
| 503C | 0.05 | No defective image formed when repeated 50,000 times |
| 504C | 2 | Stable when repeated 200,000 times or more |

TABLE 6C

| Layer constitution | | Gas employed | Flow rate (SCCM) | Flow rate ratio | Discharge power ($W/cm^2$) | Layer formation rate (Å/sec) | Layer thickness (μ) |
|---|---|---|---|---|---|---|---|
| Amorphous layer (I) | First layer | $SiH_4/He = 0.5$ $SiF_4/He = 0.5$ NO $B_2H_6/He = 10^{-3}$ | $SiH_4 + SiF_4 =$ 200 | $NO/SiH_4/SiF_4 =$ $1 \times 10^{-1}/0.5/0.5 \sim$ 0/0.5/0.5 $B_2H_6/(SiH_4 + SiF_4) =$ $4 \times 10^{-3}$ | 0.18 | 15 | 0.6 |
| | Second layer | $SiH_4/He = 0.5$ $SiF_4/He = 0.5$ | $SiH_4 + SiF_4 =$ 200 | $SiH_4/SiF_4 = 1$ | 0.18 | 15 | 20 |

TABLE 1D

| Layer constitution | | Gas employed | Flow rate (SCCM) | Flow rate ratio | Discharge power ($W/cm^2$) | Layer formation rate (Å/sec) | Layer thickness (μ) |
|---|---|---|---|---|---|---|---|
| Amorphous layer (I) | First layer | $SiH_4/He = 0.5$ NO $B_2H_6/He = 10^{-3}$ | $SiH_4 = 200$ | $NO/SiH_4 = 1 \times 10^{-1} \sim 0$ $B_2H_6/SiH_4 = 4 \times 10^{-3}$ | 0.18 | 15 | 0.6 |
| | Second layer | $SiH_4/He = 0.5$ | $SiH_4 = 200$ | | 0.18 | 15 | 20 |
| Amorphous | | $SiH_4/He = 0.5$ | $SiH_4 + SiF_4 =$ | $SiH_4:SiF_4:C_2H_4 =$ | 0.18 | 6 | 0.5 |

TABLE 1D-continued

| Layer constitution | Gas employed | Flow rate (SCCM) | Flow rate ratio | Discharge power ($W/cm^2$) | Layer formation rate (Å/sec) | Layer thickness ($\mu$) |
|---|---|---|---|---|---|---|
| layer (II) | $SiF_4He = 0.5$<br>$C_2H_4$ | 50 | 1.5:1.5:7 | | | |

Al support temperature: 250° C.
Discharge frequency: 13.56 MHz
Inner pressure upon reaction: 0.5 Torr

TABLE 2D

| Layer constitution | | Gas employed | Flow rate (SCCM) | Flow rate ratio | Discharge power ($W/cm^2$) | Layer formation rate (Å/sec) | Layer thickness ($\mu$) |
|---|---|---|---|---|---|---|---|
| Amorphous layer (I) | First layer | $SiH_4/He = 0.5$<br>NO<br>$B_2H_6/He = 10^{-3}$ | $SiH_4 = 200$ | $NO/SiH_4 = 3 \times 10^{-2} \sim 2 \times 10^{-2}$<br>$B_2H_6/SiH_4 = 2 \times 10^{-3}$ | 0.18 | 15 | 0.8 |
| | Second layer | $SiH_4/He = 0.5$<br>NO | $SiH_4 = 200$ | $NO/SiH_4 = 2 \times 10^{-2} \sim 0$ | 0.18 | 15 | 2.0 |
| | Third layer | $SiH_4/He = 0.5$ | $SiH_4 = 200$ | | 0.18 | 15 | 20 |
| Amorphous layer (II) | | $SiH_4/He = 0.5$<br>$SiF_4/He = 0.5$<br>$C_2H_4$ | $SiH_4 + SiF_4 = 15$ | $SiH_4:SiF_4:C_2H_4 = 0.3:0.1:9.6$ | 0.18 | 1.5 | 0.3 |

TABLE

| Layer constitution | | Gas employed | Flow rate (SCCM) | Flow rate ratio | Discharge power ($W/cm^2$) | Layer formation rate (Å/sec) | Layer thickness ($\mu$) |
|---|---|---|---|---|---|---|---|
| Amorphous layer (I) | First layer | $SiH_4/He = 0.5$<br>NO<br>$B_2H_6/He = 10^{-3}$ | $SiH_4 = 200$ | $NO/SiH_4 = 1.2 \times 10^{-1} \sim 0$<br>$B_2H_6/SiH_4 = 1.5 \times 10^{-3}$ | 0.18 | 15 | 1.0 |
| | Second layer | $SiH_4/He = 0.5$ | $SiH_4 = 200$ | | 0.18 | 15 | 20 |
| Amorphous layer (II) | | $SiH_4/He = 0.5$<br>$SiF_4/He = 0.5$<br>$C_2H_4$ | $SiH_4 + SiF_4 = 150$ | $SiH_4:SiF_4:C_2H_4 = 3:3:4$ | 0.18 | 10 | 1.5 |

TABLE 4D

| Sample No. | 401D | 402D | 403D | 404D | 405D | 406D | 407D | 408D |
|---|---|---|---|---|---|---|---|---|
| $SiH_4:SiF_4:C_2H_4$ | 5:4:1 | 3:3.5:3.5 | 2:2:6 | 1:1:8 | 0.6:0.4:9 | 0.2:0.3:9.5 | 0.2:0.15:9.65 | 0.1:0.1:9.8 |
| Si:C (Content ratio) | 9:1 | 7:3 | 5.5:4.5 | 4:6 | 3:7 | 2:8 | 1.2:8.8 | 0.8:9.2 |
| Image quality evaluation | Δ | ○ | ◎ | ◎ | ◎ | ○ | Δ | × |

◎ Very good
Δ Sufficiently practically usable
○ Good
× Somewhat defective images are formed.

TABLE 5D

| Sample No. | Thickness of amorphous layer (II) ($\mu$) | Result |
|---|---|---|
| 501D | 0.001 | Liable to form defective images |
| 502D | 0.02 | No defective image formed when repeated 20,000 times |

TABLE 5D-continued

| Sample No. | Thickness of amorphous layer (II) ($\mu$) | Result |
|---|---|---|
| 503D | 0.05 | Stable when repeated 50,000 times or more |
| 504D | 1 | Stable when repeated 200,000 times or more |

TABLE 6D

| Layer constitution | | Gas employed | Flow rate (SCCM) | Flow rate ratio | Discharge power ($W/cm^2$) | Layer formation rate (Å/sec) | Layer thickness ($\mu$) |
|---|---|---|---|---|---|---|---|
| Amorphous layer (I) | First layer | $SiH_4/He = 0.5$<br>$SiF_4/He = 0.5$<br>NO | $SiH_4 + SiF_4 = 200$ | $NO/SiH_4/SiF_4 = 1 \times 10^{-1}/0.5/0.5 \sim 0/0.5/0.5$ | 0.18 | 15 | 0.6 |

TABLE 6D-continued

| Layer constitution | Gas employed | Flow rate (SCCM) | Flow rate ratio | Discharge power (W/cm²) | Layer formation rate (Å/sec) | Layer thickness (μ) |
|---|---|---|---|---|---|---|
| | $B_2H_6/He = 10^{-3}$ | | $B_2H_6/(SiH_4 + SiF_4) = 4 \times 10^{-3}$ | | | |
| Second layer | $SiH_4/He = 0.5$<br>$SiF_4/He = 0.5$ | $SiH_4 + SiF_4 = 200$ | $SiH_4/SiF_4 = 1$ | 0.18 | 15 | 20 |

What is claimed is:

1. A photoconductive member which comprises a support for a photoconductive member and an amorphous layer containing an amorphous material comprising silicon atom as a matrix and at least one of a hydrogen and a halogen atom and having photoconductivity, said amorphous layer comprising a first layer region containing oxygen atom as a constituent atom, the oxygen being distributed continuously in the direction of the layer thickness $T_O$, of said first layer region and enriched at the support side, and a second layer region containing an atom of group III of the periodic table as a constituent atom, said first layer region being internally present at the support side in the amorphous layer, and the layer thickness $T_B$ of said second layer region is 50 microns or less and a layer thickness T, which is 0.5 microns or more, derived by subtracting $T_B$ from the layer thickness of the amorphous layer and satisfying the relation, $T_B/T \leqq 1$, and wherein $T_B = T_O$; $T_B > T_O$; or $T_O < T_B$.

2. A photoconductive member according to claim 1, wherein the first layer region and the second layer region share in common at least a portion of said mutual region.

3. A photoconductive member according to claim 1, wherein the first layer region is provided as an end portion layer region at the support side in said amorphous layer.

4. A photoconductive member according to claim 1, wherein the second layer region is provided as an end portion layer region at the support side in said amorphous layer.

5. A photoconductive member according to claim 1, wherein the content of hydrogen atoms in said amorphous layer is 1–40 atomic %.

6. A photoconductive member according to claim 1, wherein the content of halogen atoms in said amorphous layer is 1–40 atomic %.

7. A photoconductive member according to claim 1, wherein the total content of both hydrogen atoms and halogen atoms in said amorphous layer is 1–40 atomic %.

8. A photoconductive member according to claim 1, wherein the content of oxygen atoms in the first layer region is 0.001–50 atomic %.

9. A photoconductive member according to claim 1, wherein the content of atoms belonging to the group III of the periodic table in the second layer region is $0.01\text{–}5 \times 10^4$ atomic ppm.

10. A photoconductive member according to claim 1, wherein further an amorphous layer comprising an amorphous material containing silicon atoms and carbon atoms is provided on the amorphous layer having photoconductivity.

11. A photoconductive member according to claim 10, wherein said amorphous materials containing carbon atoms contain further hydrogen atoms.

12. A photoconductive member according to claim 10, said amorphous materials containing carbon atoms contain further halogen atoms.

13. A photoconductive member according to claim 10, said amorphous materials containing carbon atoms contain further both hydrogen atoms and halogen atoms.

14. A photoconductive member according to claim 10, wherein a layer thickness of said amorphous layer cotaining carbon atoms is 0.003–30 μ.

15. A photoconductive member according to claim 10, wherein said amorphous material containing silicon atoms and carbon atoms is selected from the group consisting of (1) $a\text{-}Si_a C_{1-a}$, wherein $0.1 \leqq \mathbf{a} \leqq 0.99999$ (2) $a\text{-}(Si_b C_{1-b})_c H_{1-c}$, wherein $0.1 \leqq \mathbf{b} \leqq 0.99999$ and $0.6 \leqq \mathbf{c} \leqq 0.99$, (3) $a\text{-}(Si_d C_{1-d})_e (X,H)_{1-e}$, wherein $0.1 \leqq \mathbf{d} \leqq 0.99999$ and $0.8 \leqq \mathbf{e} \leqq 0.99$.

16. A photoconductive member according to claim 1 wherein the first layer region has a localized region containing oxygen atoms at a higher concentration on the support side.

* * * * *

UNITED STATES PATENT AND TRADEMARK OFFICE

CERTIFICATE OF CORRECTION

PATENT NO. : 4,486,521

DATED : December 4, 1984

INVENTOR(S) : Teruo Misumi, et al.

It is certified that error appears in the above-identified patent and that said Letters Patent is hereby corrected as shown below:

Title page, after "Kyosuke Ogawa," Sakurashin" should be --, Tokyo

Col. 12, line 48, after "or" [2nd occurrence] delete "u".

Col. 13, line 33, change "BrF" to --$BrF_5$--.

Col. 14, line 48, change "$a-(Si_bC)_{1-b\ 1-c}$" to --$a-(Si_bC_{1-b})_cH_{1-c}$--;

Col. 14, line 53, change "sever" to --severe--;

Col. 14, line 62, change "similaarly" to --similarly--;

Col. 14, line 65, change "effective" to --effectively--;

Col. 14, line 66, change "acomplilshing" to --accomplishing--.

Col. 26, line 29, Table 6A, under flow rate ratio line 2 change "$1 \times 10^{-1}$ 10.5/0.05 " to --$1 \times 10^{-1}$/0.5/0.5 --.

Col. 31, line 20, 3rd Table on page Between "Table 2D" and "Table 4D" change "Table" to --Table 3D--.

Col. 33, line 30, change "$T_B/T \leqq 1$," to --$T_B/T \leq 1$,--.

Col. 34, line 29, after "10," insert --wherein--;

Col. 34, line 32, after "10," insert --wherein--;

Col. 34, line 45, change "$0.1 \leqq d \leqq 0.99999$" to --$0.1 \leq d \leq 0.9999$--.

Signed and Sealed this

*Twenty-ninth* Day of *October 1985*

[SEAL]

*Attest:*

*Attesting Officer*

DONALD J. QUIGG

*Commissioner of Patents and Trademarks—Designate*